US009613737B2

(12) United States Patent
Kato et al.

(10) Patent No.: US 9,613,737 B2
(45) **Date of Patent: *Apr. 4, 2017**

(54) R-T-B BASED SINTERED MAGNET AND PRODUCTION METHOD FOR SAME, AND ROTARY MACHINE

(71) Applicant: TDK CORPORATION, Tokyo (JP)

(72) Inventors: Eiji Kato, Tokyo (JP); Chikara Ishizaka, Tokyo (JP); Taeko Tsubokura, Tokyo (JP); Tamotsu Ishiyama, Tokyo (JP); Nobuhiro Jingu, Tokyo (JP)

(73) Assignee: TDK CORPORATION, Tokyo (JP)

( * ) Notice: Subject to any disclaimer, the term of this patent is extended or adjusted under 35 U.S.C. 154(b) by 428 days.

This patent is subject to a terminal disclaimer.

(21) Appl. No.: 14/351,199

(22) PCT Filed: Oct. 11, 2012

(86) PCT No.: PCT/JP2012/076310

§ 371 (c)(1),
(2) Date: Apr. 11, 2014

(87) PCT Pub. No.: WO2013/054842

PCT Pub. Date: Apr. 18, 2013

(65) Prior Publication Data

US 2014/0286816 A1 Sep. 25, 2014

(30) Foreign Application Priority Data

Oct. 13, 2011 (JP) ..... 2011-226040
Oct. 13, 2011 (JP) ..... 2011-226042
(Continued)

(51) Int. Cl.
*C22C 33/02* (2006.01)
*C22C 38/10* (2006.01)
(Continued)

(52) U.S. Cl.
CPC ..... *H01F 1/053* (2013.01); *B22D 11/0611* (2013.01); *C22C 38/002* (2013.01);
(Continued)

(58) Field of Classification Search
CPC ... B22D 11/0611; H01F 1/053; H01F 1/0536; H01F 1/0571; H01F 1/0577;
(Continued)

(56) References Cited

U.S. PATENT DOCUMENTS 5,431,747 A * 7/1995 Takebuchi ..... C22C 33/02 420/83
7,311,788 B2 * 12/2007 Nishizawa ..... C22C 38/002 148/302
(Continued)

FOREIGN PATENT DOCUMENTS

CN 1442253 A 9/2003
CN 1942264 A 4/2007
(Continued)

OTHER PUBLICATIONS

Apr. 15, 2014 International Preliminary Report on Patentability issued in International Application No. PCT/JP2012/076327.
(Continued)

*Primary Examiner* — Helene Klemanski
(74) *Attorney, Agent, or Firm* — Oliff PLC

(57) ABSTRACT

An R-T-B sintered magnet including a composition containing a rare earth element, a transition element and boron, containing essentially no dysprosium as a rare earth element, and having crystal grains with a composition containing a rare earth element, a transition element and boron, and grain boundary regions formed between the crystal grains, wherein the triple point regions which are grain boundary regions surrounded by 3 or more crystal grains have a composition containing a rare earth element, a transition
(Continued)

element and boron and have a higher mass ratio of the rare earth element than the crystal grains, the average value of the area of the triple point regions in a cross-section being no greater than 2 $\mu m^2$ and the standard deviation of the area distribution being no greater than 3.

7 Claims, 20 Drawing Sheets

(30) Foreign Application Priority Data

Nov. 14, 2011 (JP) ..... 2011-248978
Nov. 14, 2011 (JP) ..... 2011-248980

(51) Int. Cl.

| | |
|---|---|
| ***B22D 11/06*** | (2006.01) |
| ***H01F 1/053*** | (2006.01) |
| ***H01F 1/057*** | (2006.01) |
| ***H01F 1/08*** | (2006.01) |
| ***H01F 41/02*** | (2006.01) |
| ***C22C 38/00*** | (2006.01) |
| ***C22C 38/06*** | (2006.01) |
| ***C22C 38/14*** | (2006.01) |
| ***C22C 38/16*** | (2006.01) |

(52) U.S. Cl.
CPC ..... *C22C 38/005* (2013.01); *C22C 38/06* (2013.01); *C22C 38/10* (2013.01); *C22C 38/14* (2013.01); *C22C 38/16* (2013.01); *H01F 1/0536* (2013.01); *H01F 1/0571* (2013.01); *H01F 1/086* (2013.01); *H01F 41/0266* (2013.01); *C22C 33/02* (2013.01); *C22C 2202/02* (2013.01); *H01F 1/0577* (2013.01)

(58) Field of Classification Search
CPC ..... H01F 1/086; H01F 41/0266; C22C 33/02; C22C 38/002; C22C 38/005; C22C 38/10; C22C 2202/02
USPC ..... 148/101; 419/33; 420/83; 75/246
See application file for complete search history.

(56) References Cited

U.S. PATENT DOCUMENTS

| | | | | |
|---|---|---|---|---|
| 7,314,531 | B2 * | 1/2008 | Ishizaka | H01F 1/0577 148/302 |
| 7,390,369 | B2 | 6/2008 | Odaka et al. | |
| 8,152,936 | B2 * | 4/2012 | Tsubokura | H01F 1/0577 420/83 |
| 8,157,927 | B2 * | 4/2012 | Enokido | H01F 1/0577 148/101 |
| 2006/0165550 | A1 * | 7/2006 | Enokido | H01F 1/0577 420/40 |
| 2007/0199624 | A1 | 8/2007 | Shintani et al. | |
| 2010/0200121 | A1 | 8/2010 | Shintani et al. | |
| 2012/0024429 | A1 * | 2/2012 | Hayakawa | H01F 1/0577 148/302 |
| 2012/0235778 | A1 * | 9/2012 | Kunieda | H01F 1/0577 335/302 |
| 2014/0247100 | A1 * | 9/2014 | Tsubokura | H01F 1/053 419/33 |
| 2014/0286815 | A1 * | 9/2014 | Ishiyama | H01F 1/053 419/33 |
| 2014/0286816 | A1 * | 9/2014 | Kato | H01F 1/053 419/33 |
| 2014/0308152 | A1 * | 10/2014 | Tsubokura | H01F 1/053 419/33 |

FOREIGN PATENT DOCUMENTS

| | | |
|---|---|---|
| JP | B2-3693838 | 9/2005 |
| JP | A-2006-265609 | 10/2006 |
| JP | A-2008-264875 | 11/2008 |
| JP | A-2011-210838 | 10/2011 |
| WO | 2004/094090 A1 | 11/2004 |
| WO | WO 2005/095024 A1 | 10/2005 |

OTHER PUBLICATIONS

Apr. 15, 2014 International Preliminary Report of Patentability issued in International Application No. PCT/JP2012/076346.
Apr. 15, 2014 International Preliminary Report of Patentability issued in International Application No. PCT/JP2012/076324.
Jan. 22, 2013 International Search Report issued in International Patent Application No. PCT/JP2012/076327.
Jan. 22, 2013 International Search Report issued in International Patent Application No. PCT/JP2012/076346.
Jan. 22, 2013 International Search Report issued in International Patent Application No. PCT/JP2012/076324.
Jan. 22, 2013 International Search Report issued in International Patent Application No. PCT/JP2012/076310.
U.S. Appl. No. 14/350,438, filed Apr. 8, 2014 in the name of Tsubokura et al.
U.S. Appl. No. 14/351,119, filed Apr. 10, 2014 in the name of Ishiyama et al.
U.S. Appl. No. 14/350,728, filed Apr. 9, 2014 in the name of Tsubokura et al.
Apr. 15, 2014 International Preliminary Report on Patentability issued in International Patent Application No. PCT/JP2012/076310.
Aug. 19, 2016 Office Action Issued in U.S Appl. No. 14/350,438.
Aug. 19, 2016 Office Action issued in U.S. Appl. No. 14/351,119.

* cited by examiner

A

B

R-T-B BASED SINTERED MAGNET AND PRODUCTION METHOD FOR SAME, AND ROTARY MACHINE

TECHNICAL FIELD

The present invention relates to an R-T-B sintered magnet and a method for its production, and to a rotary machine comprising the R-T-B sintered magnet.

BACKGROUND ART

R-T-B sintered magnets (where R is at least one element selected from among rare earth elements including Y, T is a transition element and B is boron) are used in a variety of electrical devices for their excellent magnetic properties.

Residual flux density (Br) and coercive force (HcJ) are generally used as indices of the magnetic properties of magnets. It is known that the HcJ value can be increased in an R-T-B sintered magnet by using Dy (dysprosium) as part of the rare earth element.

Such an R-T-B sintered magnet is fabricated by a common powder metallurgy process, and its cross-sectional structure is typically a structure such as shown in FIG. 2. Specifically, the R-T-B sintered magnet 100 comprises crystal grains 120 comprising an $R_2T_{14}B$ phase as the main crystal phase (main phase), and grain boundary regions 140 present at the grain boundaries. A phase with a higher R content than the $R_2T_{14}B$ phase is present at these grain boundary regions 140.

In order to increase the HcJ value of the R-T-B sintered magnet 100, it is effective to micronize the crystal grains 120. In order to micronize the crystal grains 120, it is necessary to micronize the particle diameter of the alloy powder used as starting material. When micronized alloy powder is used, however, the phase with a higher R content than the $R_2T_{14}B$ phase tends to segregate during sintering, and it is difficult to sufficiently increase the HcJ value. For this reason it has been proposed, in PTL 1 for example, to limit the triple point mean area and the standard deviation of the area distribution to no greater than prescribed values, in order to avoid segregation of the phase with a higher R content than the $R_2T_{14}B$ phase.

CITATION LIST

Patent Literature

[PTL 1] Japanese Unexamined Patent Application Publication No. 2011-210838

SUMMARY OF INVENTION

Technical Problem

When an R-T-B sintered magnet has a structure such as shown in FIG. 1, and Dy is used as R, Dy is also present in the phase with a higher R content than the $R_2T_{14}B$ phase. However, since Dy has the property of being easily oxidized among the rare earth elements, the corrosion resistance of the R-T-B sintered magnet can potentially be reduced. On the other hand, it is desirable for an R-T-B sintered magnet not only to exhibit initial properties but also to maintain high magnetic properties for prolonged periods.

The present invention has been accomplished in light of this situation, and one object thereof is to provide an R-T-B sintered magnet with high magnetic properties and excellent corrosion resistance, and a method for its production. It is another object of the invention to provide a rotary machine capable of maintaining high output for prolonged periods.

Solution to Problem

The invention provides an R-T-B sintered magnet having a composition comprising a rare earth element, a transition element and boron, the R-T-B sintered magnet comprising essentially no dysprosium as a rare earth element, and having crystal grains having a composition comprising a rare earth element, a transition element and boron, and grain boundary regions formed between the crystal grains, wherein the triple point regions which are grain boundary regions surrounded by 3 or more crystal grains have a composition comprising a rare earth element, a transition element and boron and having a higher mass ratio of the rare earth element than the crystal grains, the average value of the area of the triple point regions in a cross-section being no greater than 2 $\mu m^2$ and the standard deviation of the area distribution being no greater than 3. Here, R represents a rare earth element other than dysprosium, T represents a transition element and B represents boron.

The R-T-B sintered magnet of the invention contains essentially no dysprosium, and therefore oxidation is reduced compared to a sintered magnet containing dysprosium, and the corrosion resistance is therefore excellent. In addition, since the average value for the triple point region area is smaller than in the prior art, it is possible to improve the homogeneity of distribution and thus allow segregation of the phase with a higher R content than the $R_2T_{14}B$ phase to be minimized. Since the R-T-B sintered magnet of the invention thus has a micronized construction and improved homogeneity of structure, it is possible to maintain high magnetic properties even without containing dysprosium. In other words, the R-T-B sintered magnet of the invention realizes both high magnetic properties and excellent corrosion resistance by synergistic action between selection of the rare earth element and structural control.

The mean particle diameter of the crystal grains in the R-T-B sintered magnet of the invention is preferably 0.5 to 5 μm. An R-T-B sintered magnet constructed with such micronized crystal grains can exhibit even higher magnetic properties.

Preferably, the rare earth element content of the R-T-B sintered magnet of the invention is 25 to 37 mass %, the boron content is 0.5 to 1.5 mass % and the cobalt content among the transition metals is no greater than 3 mass % (not including 0), with the remainder iron. By having such a construction it is possible to exhibit even higher magnetic properties.

The R-T-B sintered magnet of the invention comprises dendritic crystal grains containing an $R_2T_{14}B$ phase, and grain boundary regions containing a phase with a higher R content than the $R_2T_{14}B$ phase, and preferably it is obtained by molding and firing a ground product of an R-T-B alloy strip having an average value of no greater than 3 μm for the spacing between the phases with a higher R content than the $R_2T_{14}B$ phase in a cross-section. Since such an R-T-B sintered magnet is obtained using a ground product that is sufficiently micronized and has a sharp particle size distribution, it is possible to obtain an R-T-B based sintered compact composed of fine crystal grains. In addition, since the phase with a higher R content than the $R_2T_{14}B$ phase will be present in a higher proportion at the outer periphery than in the interior of the ground product, the state of dispersion of the phase with a higher R content than the $R_2T_{14}B$ phase after sintering will tend to be more satisfactory. Thus, the structure of the R-T-B based sintered compact will be micronized and the homogeneity will be improved. It will thereby be possible to further increase the magnetic properties of the R-T-B based sintered compact.

The invention also provides a rotary machine comprising an R-T-B sintered magnet according to the invention. Since the rotary machine of the invention has an R-T-B sintered magnet with the features described above, it can stably exhibit high output for prolonged periods.

The present invention further provides a method for production of an R-T-B sintered magnet containing essentially no dysprosium, the method for production of an R-T-B sintered magnet comprising the steps of: preparing an R-T-B alloy strip having dendritic crystal grains that have a composition comprising a rare earth element, a transition element and boron, and grain boundary regions with a composition having a higher mass ratio of rare earth elements than the crystal grains, wherein the average value of the spacing between grain boundary regions is no greater than 3 μm; grinding the R-T-B alloy strip to obtain an alloy powder; and molding and firing the alloy powder in a magnetic field to produce an R-T-B sintered magnet having a composition comprising a rare earth element, a transition element and boron. Here, R represents a rare earth element other than dysprosium, T represents a transition element and B represents boron.

In the production method of the invention there is used an R-T-B alloy strip with an average value of no greater than 3 μm for the spacings between grain boundary regions, and therefore by grinding it is possible to obtain an alloy powder that is sufficiently micronized and has low particle size variation. In addition, using such an alloy powder results in the phase with a higher R content than the $R_2T_{14}B$ phase in the grain boundary regions being present in a higher proportion at the outer periphery than in the interior of the ground product, and therefore the state of dispersion of the triple point regions after sintering tends to be more satisfactory. Thus, it is possible to obtain an R-T-B sintered magnet constructed with fine crystal grains and having minimal segregation of triple point regions. Furthermore, because it contains no dysprosium, oxidation can be reduced and excellent corrosion resistance is exhibited. In other words, an R-T-B sintered magnet obtained by the production method of the invention makes it possible to achieve both high magnetic properties and excellent corrosion resistance by synergistic action between selection of the rare earth element in the starting material and structural control.

Advantageous Effects of Invention

According to the invention it is possible to provide an R-T-B sintered magnet with high magnetic properties and excellent corrosion resistance, as well as a method for its production. According to the invention it is also possible to provide a rotary machine capable of maintaining high output for prolonged periods.

DESCRIPTION OF EMBODIMENTS

Figure 1:
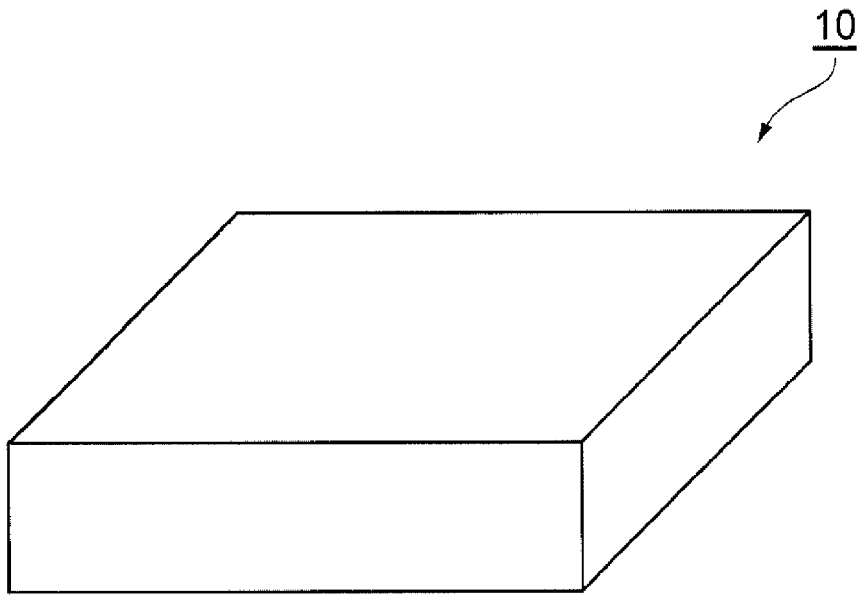
FIG. 1 is a perspective view of a preferred embodiment of an R-T-B sintered magnet of the invention.

Preferred embodiments of the invention will now be explained in detail, with reference to the accompanying drawings as necessary. For the drawings, identical or corresponding elements will be referred to by like reference numerals and will be explained only once.

Figure 2:
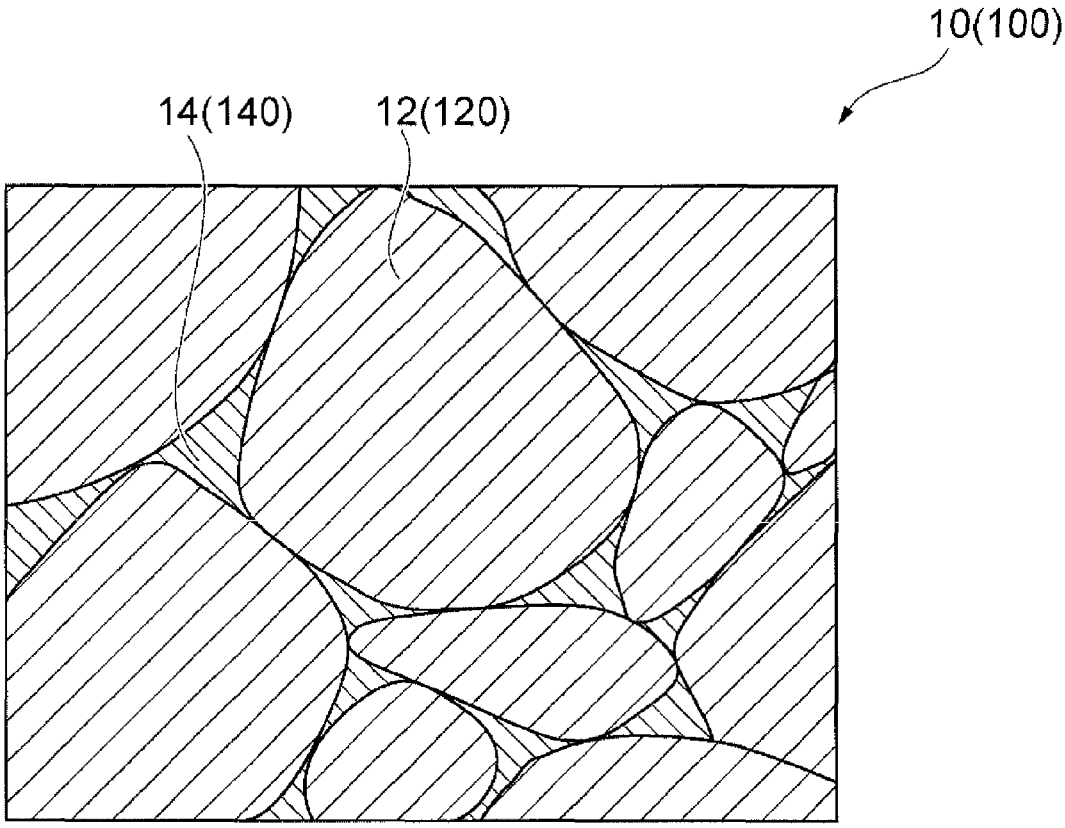
FIG. 2 is a cross-sectional view schematically showing the cross-sectional structure of an embodiment of an R-T-B sintered magnet according to the invention.

FIG. 1 is a perspective view of an R-T-B sintered magnet 10 according to a preferred embodiment of the invention. FIG. 2 is a cross-sectional view schematically showing the cross-sectional structure of an R-T-B sintered magnet 10 according to a preferred embodiment of the invention. As shown in FIG. 2, the R-T-B sintered magnet 10 of this embodiment has a plurality of crystal grains 12, and triple point regions 14 that are the grain boundary regions between the crystal grains 12 and are surrounded by 3 or more crystal grains 12. While not shown in FIG. 1, grain boundary regions may also be formed between two adjacent crystal grains 12.

The R-T-B sintered magnet 10 of this embodiment has a general composition comprising a rare earth element, a transition element other than a rare earth element, and boron, and it contains a rare earth element other than Dy as the rare earth element (R). Specifically, R includes at least one element selected from among scandium (Sc), yttrium (Y), lanthanum (La), cerium (Ce), praseodymium (Pr), neodymium (Nd), samarium (Sm), europium (Eu), gadolinium (Gd), terbium (Tb), holmium (Ho), erbium (Er), thulium (Tm), ytterbium (Yb) and lutetium (Lu).

From the viewpoint of further improving the corrosion resistance, R in the R-T-B sintered magnet 10 is preferably not only not Dy but also not Tb and/or Ho, and more preferably it does not contain a heavy rare earth element. In other words, it more preferably contains only light rare earth elements as R. Throughout the present specification, heavy rare earth elements (HR) are Gd, Tb, Dy, Ho, Er, Tm, Yb and Lu, and light rare earth elements (LR) are rare earth elements other than these. However, the R-T-B sintered magnet 10 may contain heavy rare earth elements (Dy, Tb, Ho and the like) as impurities of the starting material or impurities introduced as contaminants during production. The content is preferably no greater than 0.01 mass % based on the total R-T-B sintered magnet. The upper limit for the content is 0.1 mass %, as a range that has virtually no influence on the object and effect of the invention.

Throughout the present specification, "comprising essentially no Dy" means that it may still comprise Dy on the level of an unavoidable impurity in the starting material, for example. Thus, the proportion of Dy with respect to the total R in the R-T-B sintered magnet 10 is less than 0.1 mass %, for example. Also, "essentially does not contain Tb and/or Ho" means that it may contain Tb and/or Ho on the level of unavoidable impurities in the starting material, for example. Thus, the proportions of Tb and Ho with respect to the total R in the R-T-B sintered magnet 10 are each less than 0.1 mass %, for example.

The R-T-B sintered magnet 10 preferably comprises at least Fe as a transition element (T), and more preferably it comprises a combination of Fe and a transition element other than Fe. Transition elements other than Fe include Co, Cu and Zr.

The R-T-B sintered magnet 10 preferably comprises at least one element selected from among Al, Cu, Ga, Zn and Ge. This will allow an R-T-B sintered magnet 10 to be obtained with even higher coercive force. The R-T-B sintered magnet 10 also preferably comprises at least one element selected from among Ti, Zr, Ta, Nb, Mo and Hf. By including such elements it is possible to suppress grain growth during firing, and further increase the coercive force of the R-T-B sintered magnet 10.

The R content of the R-T-B sintered magnet 10 is preferably 25 to 37 mass % and more preferably 28 to 35 mass %, from the viewpoint of further increasing the magnetic properties. The B content of the R-T-B sintered magnet 10 is preferably 0.5 to 1.5 mass % and more preferably 0.7 to 1.2 mass %.

If the rare earth element content is less than 25 mass %, the amount of production of the $R_2T_{14}B$ phase as the main phase of the R-T-B sintered magnet 10 will be reduced, α-Fe and the like having soft magnetism will be deposited more readily, and HcJ may potentially be reduced. If it is greater than 37 mass %, on the other hand, potentially the volume ratio of the $R_2T_{14}B$ phase may be reduced and the Br value lowered.

From the viewpoint of further increasing the coercive force, the R-T-B sintered magnet 10 preferably contains a total of 0.2 to 2 mass % of at least one type of element selected from among Al, Cu, Ga, Zn and Ge. From the same viewpoint, the R-T-B sintered magnet 10 also preferably comprises a total of 0.1 to 1 mass % of at least one element selected from among Ti, Zr, Ta, Nb, Mo and Hf.

The content of transition elements (T) in the R-T-B sintered magnet 10 is the remainder after the aforementioned rare earth elements, boron and added elements.

When Co is included as a transition element, the content is preferably no greater than 3 mass % (not including 0), and more preferably 0.3 to 1.2 mass %. Co forms a phase similar to Fe, and including Co can increase the Curie temperature and corrosion resistance of the grain boundary phase.

The oxygen content of the R-T-B sintered magnet 10 is preferably 300 to 3000 ppm and more preferably 500 to 1500 ppm, from the viewpoint of achieving high levels for both magnetic properties and corrosion resistance. The nitrogen content of the R-T-B sintered magnet 10 is 200 to 1500 ppm and preferably 500 to 1500 ppm, from the same viewpoint explained above. The carbon content of the R-T-B sintered magnet 10 is 500 to 3000 ppm and preferably 800 to 1500 ppm, from the same viewpoint explained above.

The crystal grains 12 of the R-T-B sintered magnet 10 preferably include an $R_2T_{14}B$ phase. On the other hand, the triple point regions 14 include a phase with a higher R content ratio than the $R_2T_{14}B$ phase, based on mass compared to the $R_2T_{14}B$ phase. The average value of the area of the triple point regions 14 in a cross-section of the R-T-B sintered magnet 10 is no greater than 2 $\mu m^2$ and preferably no greater than 1.9 $\mu m^2$, as the arithmetic mean. Also, the standard deviation for the area distribution is no greater than 3 and preferably no greater than 2.6. Since the R-T-B sintered magnet 10 of this embodiment thus has minimal segregation of the phase with a higher R content than the $R_2T_{14}B$ phase, the area of the triple point regions 14 is low and the variation in area is also reduced. It is thus possible to maintain high levels for both Br and HcJ.

The average value for the area of the triple point regions 14 in the cross-section, and the standard deviation for the area distribution, can be calculated in the following manner. First, the R-T-B sintered magnet 10 is cut and the cut surface is polished. The polished surface image is observed with a scanning electron microscope. Image analysis is performed and the area of the triple point regions 14 is calculated. The arithmetic mean value for the calculated area is the mean area. Also, the standard deviation for the area of the triple point regions 14 can be calculated based on the area of each of the triple point regions 14 and their average value.

The rare earth element content in the triple point regions 14 is preferably 80 to 99 mass %, more preferably 85 to 99 mass % and even more preferably 90 to 99 mass %, from the viewpoint of obtaining an R-T-B sintered magnet with sufficiently high magnetic properties and sufficiently excellent corrosion resistance. From the same viewpoint, the rare earth element contents of each of the triple point regions 14 are preferably equal. Specifically, the standard deviation for the content distribution in the triple point regions 14 of the R-T-B sintered magnet 10 is preferably no greater than 5, preferably no greater than 4 and more preferably no greater than 3.

The mean particle diameter for the crystal grains 12 of the R-T-B sintered magnet 10 is preferably 0.5 to 5 μm and more preferably 2 to 4.5 μm, from the viewpoint of further increasing the magnetic properties. The mean particle diameter can be calculated by performing image processing of the electron microscope image of a cross-section of the R-T-B sintered magnet 10, measuring the particle diameters of the individual crystal grains 12, and taking the arithmetic mean of the measured values.

A preferred embodiment of the method for production of the R-T-B sintered magnet 10 will now be described. The production method of this embodiment has a first step in which an R-T-B alloy strip is prepared having dendritic crystal grains comprising a $R_2T_{14}B$ phase that contains essentially no dysprosium, and grain boundary regions comprising a phase with a higher mass ratio of rare earth elements than the $R_2T_{14}B$ phase, and with an average value of no greater than 3 pin for the spacings between the grain boundary regions, a second step in which the R-T-B alloy strip is ground to obtain an alloy powder, and a third step in which the alloy powder is molded and fired in a magnetic field to produce an R-T-B sintered magnet comprising a $R_2T_{14}B$ phase and containing no dysprosium. Each step will now be explained in detail.

(First Step)

In the first step, an R-T-B alloy strip is prepared having an average value of no greater than 3 μm for the spacings between the grain boundary regions that comprise a phase with a higher R content than the $R_2T_{14}B$ phase. First, as starting materials there are prepared compounds having R (excluding Dy), T and B as constituent elements, or R, T and B alone. These starting materials are used to produce an R-T-B alloy strip having a prescribed composition, by a strip casting method.

Figure 3:
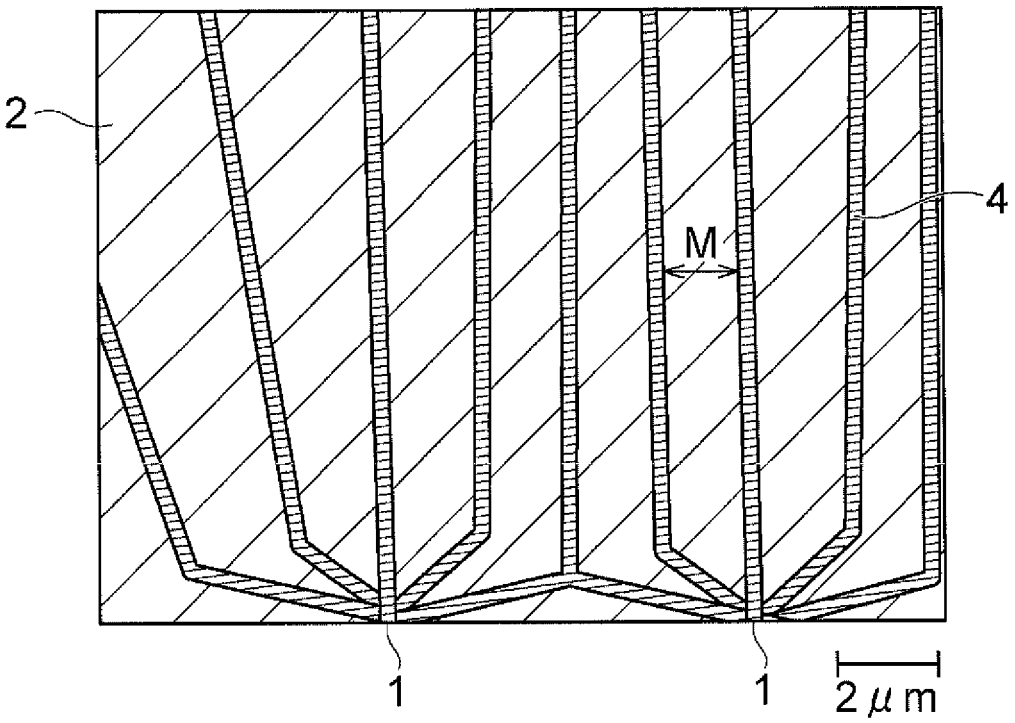
FIG. 3 is a schematic diagram showing an example of the cross-sectional structure of an alloy strip used in the method for production of an R-T-B sintered magnet according to the invention.

FIG. 3 is a schematic cross-sectional enlarged view showing the cross-sectional structure of an R-T-B alloy strip to be used in the production method of this embodiment, along the thickness direction. The R-T-B alloy strip of this embodiment contains crystal grains 2 comprising a $R_2T_{14}B$ phase as the main phase, and grain boundary regions 4 having a different composition than the $R_2T_{14}B$ phase. The grain boundary regions 4 comprise a phase with a higher R content than the $R_2T_{14}B$ phase.

As shown in FIG. 3, the R-T-B alloy strip has crystal nuclei 1 on one surface. Also, the columnar crystal grains 2 comprising an $R_2T_{14}B$ phase and the grain boundary regions 4 comprising a phase with a higher R content than the $R_2T_{14}B$ phase (an R-rich phase) extend in a radial fashion from the crystal nuclei 1 as origins, toward the other surface. That is, the phase with a higher R content than the $R_2T_{14}B$ phase is deposited along the grain boundaries of the $R_2T_{14}B$ phase.

The R-T-B alloy strip used for the production method of this embodiment does not have significant spread of the $R_2T_{14}B$ phase-containing crystal grains 2 in the direction perpendicular to the thickness direction (the left-right direction in FIG. 3), in a cross-section along the thickness direction as shown in FIG. 3, but instead they grow essentially uniformly in the thickness direction (the up-down direction in FIG. 3). Consequently, the spacing M between the grain boundary regions 4 is smaller compared to a conventional R-T-B alloy strip, and variation in the spacing M is also reduced. With ordinary grinding, an R-T-B alloy strip fractures along the grain boundary regions 4. Therefore, when the R-T-B alloy strip is ground in the second step it is possible to obtain an alloy powder that is micronized and has low variation in particle diameter and shape.

The R-T-B alloy strip preferably has an average value $D_{AVE}$ of 1 to 3 μm for the spacing M between the grain boundary regions 4 in the cross-section shown in FIG. 3. This will allow an R-T-B sintered magnet 10 to be obtained having even higher magnetic properties. The lower limit for $D_{AVE}$ may be 1.5 μm. The upper limit for $D_{AVE}$ may be 2.7 μm.

The value of $D_{AVE}$ can be determined by the following procedure. First, the average value for the spacing M between the grain boundary regions 4 on one (the lower) surface side, the average value for the spacing M between the grain boundary regions 4 at the center section, and the average value for the spacing M between the grain boundary regions 4 on the other (the upper) surface side, are determined for the cross-section shown in FIG. 3. These average values are recorded as $D_1$, $D_2$ and $D_3$, respectively.

Specifically, $D_1$, $D_2$ and $D_3$ are determined in the following manner. First, a cross-section such as shown in FIG. 3 is observed by SEM (scanning electron microscope)-BEI (backscattered electron image) (magnification: 1000×). Also, photographs are taken of the cross-section in 15 visual fields, on one surface side, on the other surface side, and at the center section. In the photographs, straight lines are drawn between a location 50 μm on the center section side from the one surface, a location 50 μm on the center section side from the other surface, and the center section. The straight lines are essentially parallel to the one surface and the other surface in the cross-section shown in FIG. 3. The values of $D_1$, $D_2$ and $D_3$ can be determined from the length of the straight line and the number of crystal grains 2 transected by the straight line. The average values $D_1$, $D_2$ and $D_3$ determined in this manner are the $D_{AVE}$ values.

The R-T-B alloy strip may be produced by a strip casting method using a cooling roll as described below. In this case, $R_2T_{14}B$ phase crystal nuclei 1 of the R-T-B alloy strip are deposited on the contact surface with the cooling roll (the casting surface). The crystal grains 2 comprising an $R_2T_{14}B$ phase grow in a radial fashion from the casting surface side of the R-T-B alloy strip toward the side opposite the casting surface (the free surface). Thus, in the R-T-B alloy strip shown in FIG. 3, the lower surface is the casting surface. In this case, $D_1$ is the average value for the spacing M between the grain boundary regions 4 on the casting surface side, and $D_2$ is the average value for the spacing M between the grain boundary regions 4 on the free surface side. The values of $D_1$, $D_2$ and $D_3$ are, for example, 1 to 4 μm, preferably 1.4 to 3.5 μm, and more preferably 1.5 to 3.2 μm.

In a strip casting method, a molten alloy having a prescribed composition is poured onto the roll surface of a cooling roll and the molten alloy is cooled by the roll surface to produce crystal nuclei. The spacing M between the grain boundary regions may be adjusted by modifying the surface of the roll surface, or it may be adjusted by changing the molten metal temperature, the cooling roll surface condition, the cooling roll material, the cooling roll material, the roll surface temperature, the cooling roll rotational speed or the cooling temperature. For example, the cooling roll may have a concavoconvex pattern formed by mesh-like grooves on the roll surface. The concavoconvex pattern is composed of, for example, a plurality of first recesses arranged at a prescribed spacing a along the circumferential direction of the cooling roll and a plurality of second recesses arranged essentially perpendicular to the first recesses and at a prescribed spacing b parallel to the axial direction of the cooling roll. The first recesses and second recesses are essentially straight linear grooves having prescribed depths.

Figure 4:
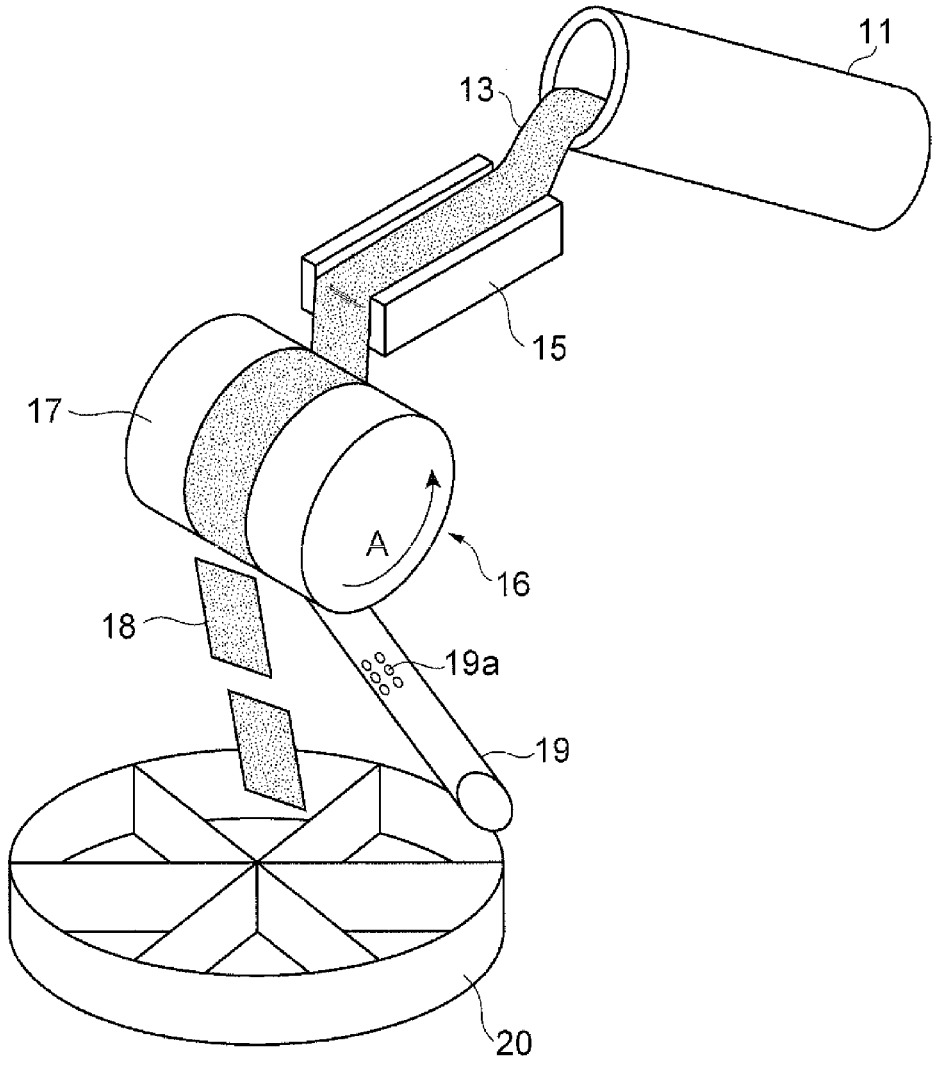
FIG. 4 is a schematic diagram of an apparatus to be used in a strip casting method.

FIG. 4 is a schematic diagram showing an example of an apparatus to be used for cooling of a molten alloy in a strip casting method. The molten alloy 13 prepared in a high-frequency melting furnace 11 is first transferred to a tundish 15. Next, the molten alloy 13 is poured from the tundish 15 onto the roll surface 17 of the cooling roll 16 rotating at a prescribed speed in the direction of the arrow A. The molten alloy 13 contacts with the roll surface 17 of the cooling roll 16 and loses heat by heat exchange. As the molten alloy 13 cools, crystal nuclei are formed in the molten alloy 13 and at least part of the molten alloy 13 solidifies. For example, an $R_2T_{14}B$ phase (melting temperature of about 1100° C.) is formed first, and then at least part of the R-rich phase (melting temperature of about 700° C.) solidifies. The crystal deposition is affected by the structure of the roll surface 17 with which the molten alloy 13 contacts. It is preferred to employ a concavoconvex pattern, comprising mesh-like recesses and raised sections formed by recesses, that has been formed on the roll surface 17 of the cooling roll 16.

Figure 5:
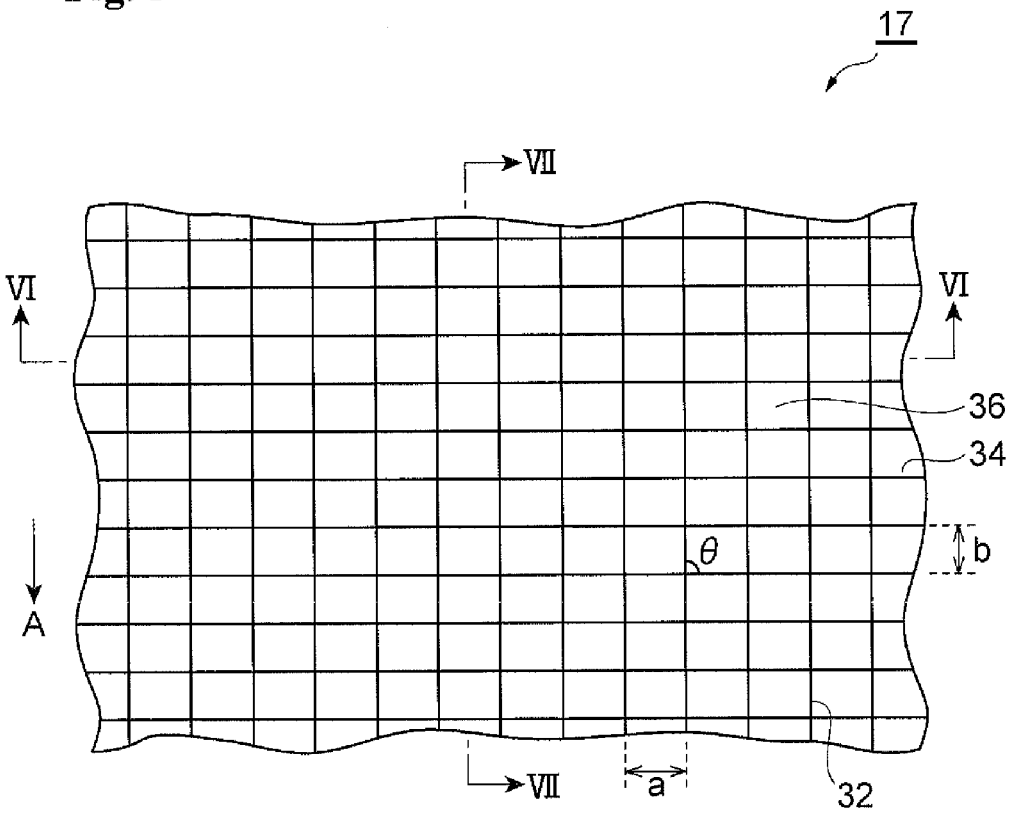
FIG. 5 is an enlarged plan view showing an example of the roll surface of a cooling roll used for production of an R-T-B sintered magnet of the invention.

FIG. 5 is a schematic diagram showing a flat enlarged view of part of a roll surface 17. Mesh-like grooves are formed in the roll surface 17, and these form the concavoconvex pattern. Specifically, the roll surface 17 has a plurality of first recesses 32 arranged at a prescribed spacing a and a plurality of second recesses 34 arranged essentially perpendicular to the first recesses 32 and at a prescribed spacing b parallel to the axial direction of the cooling roll 16, which are formed along the circumferential direction of the cooling roll 16 (the direction of the arrow A). The first recesses 32 and second recesses 34 are essentially straight linear grooves having prescribed depths. Raised sections 36 are formed by the first recesses 32 and second recesses 34.

The surface roughness Rz of the roll surface 17 is preferably 3 to 5 μm, more preferably 3.5 to 5 μm and even more preferably 3.9 to 4.5 μm. If Rz is too large the thickness of the strip will vary tending to increase variation in the cooling rate, whereas if Rz is too small, adhesiveness between the molten alloy and the roll surface 17 will be insufficient, and the molten alloy or alloy strip will tend to detach from the roll surface earlier than the target time. In this case, the molten alloy migrates to the secondary cooling section without sufficient progression of heat loss of the molten alloy. Therefore, the alloy strips will tend to inconveniently stick together at the secondary cooling section.

The surface roughness Rz, throughout the present specification, is the ten-point height of irregularities and is the value measured according to JIS B 0601-1994. Rz can be measured using a commercially available measuring apparatus (SURFTEST by Mitsutoyo Corp.).

The angle θ formed by the first recesses 32 and the second recesses 34 is preferably 80-100° and more preferably 85-95°. By specifying such an angle θ, it will be possible for greater columnar growth of the crystal nuclei of the $R_2T_{14}B$ phase deposited on the raised sections 36 of the roll surface 17 to proceed toward the thickness direction of the alloy strip.

Figure 6:
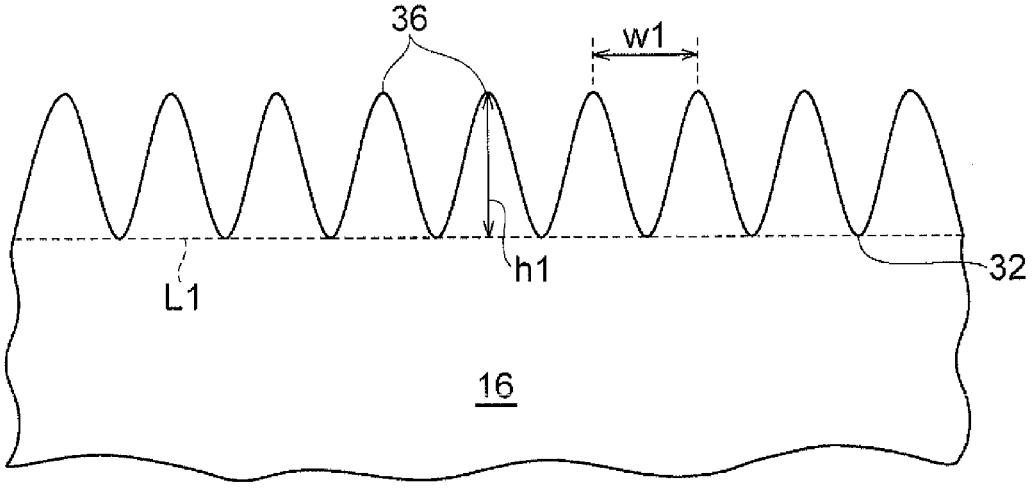
FIG. 6 is a schematic cross-sectional view showing an example of the cross-sectional structure near the roll surface of a cooling roll used for production of an R-T-B sintered magnet according to the invention.

FIG. 6 is a schematic enlarged cross-sectional view showing a cross-section of FIG. 5 along line VI-VI. Specifically, FIG. 5 is a schematic cross-sectional view showing a portion of the cross-sectional structure of a cooling roll 16 cut through the axis on a plane parallel to the axial direction. The heights h1 of the raised sections 36 can be calculated as the shortest distances between the apexes of the raised sections 36 and a straight line L1 passing through the bases of the first recesses 32 and parallel to the axial direction of the cooling roll 16, in the cross-section shown in FIG. 6. Also, the spacing w1 of the raised sections 36 can be calculated as the distance between apexes of adjacent raised sections 36, in the cross-section shown in FIG. 6.

Figure 7:
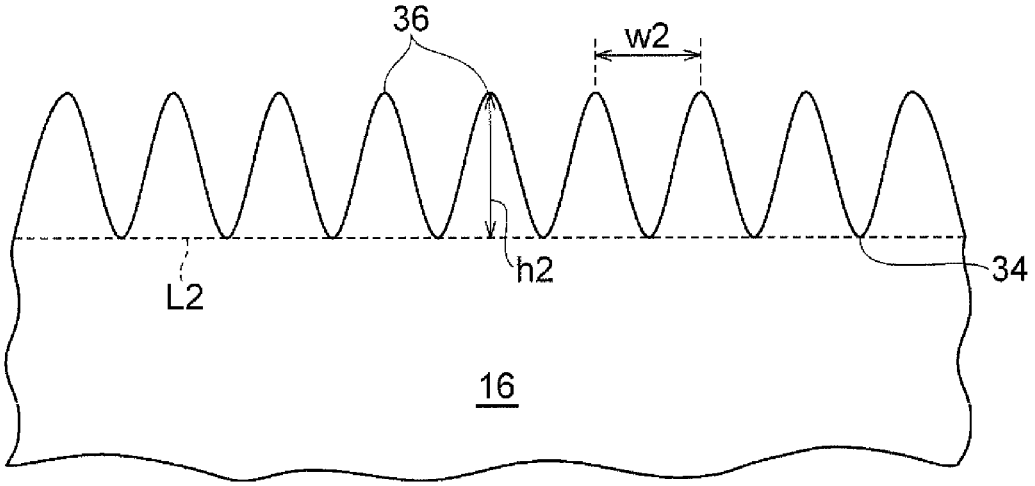
FIG. 7 is a schematic cross-sectional view showing an example of the cross-sectional structure near the roll surface of a cooling roll used for production of an R-T-B sintered magnet according to the invention.

FIG. 7 is a schematic enlarged cross-sectional view showing a cross-section of FIG. 5 along line VII-VII. Specifically, FIG. 7 is a schematic cross-sectional view showing a portion of the cross-sectional structure of a cooling roll 16 cut on a plane parallel to the side. The heights h2 of the raised sections 36 can be calculated as the shortest distances between the apexes of the raised sections 36 and a straight line L2 passing through the bases of the second recesses 34 and perpendicular to the axial direction of the cooling roll 16, in the cross-section shown in FIG. 7. Also, the spacing w2 of the raised sections 36 can be calculated as the distance between apexes of adjacent raised sections 36, in the cross-section shown in FIG. 7.

Throughout the present specification, the average value H of the heights of the raised sections 36 and the average value W of the spacing between raised sections 36 are calculated in the following manner. Using a laser microscope, a profile image (magnification: 200×) is taken of a cross-section of the cooling roll 16 near the roll surface 17, as shown in FIGS. 6 and 7. In these images, 100 points are measured for both heights h1 and heights h2 of arbitrarily selected raised sections 36. Here, measurement is made only for heights h1 and h2 that are 3 μm or greater, including no data for heights of less than 3 μm. The arithmetic mean value of measurement data for a total of 200 points is recorded as the average value for the heights of the raised sections 36.

Also, in the same image, 100 points are measured for both spacings w1 and spacings w2 of arbitrarily selected raised sections 36. Measurement of the spacings is conducted considering only heights h1 and h2 of 3 μm and greater as raised sections 36. The arithmetic mean value of measurement data for a total of 200 points is recorded as the average value W for the spacings of the raised sections 36. When it is difficult to observe a concavoconvex pattern on the roll surface 17 with a scanning electron microscope, a replica may be formed by replicating the concavoconvex pattern of the roll surface 17, and the surface of the replica observed with a scanning electron microscope and measured as described above. A replica can be formed using a commercially available kit (SUMP SET by Kenis, Ltd.).

The concavoconvex pattern of the roll surface 17 can be adjusted by working the roll surface 17 with a short wavelength laser, for example.

The average value H of the heights of the raised sections 36 is preferably 7 to 20 μm. This will cause the recesses 32, 34 to be thoroughly saturated with the molten alloy and allow adhesiveness between the molten alloy 12 and roll surface 17 to be sufficiently increased. The upper limit for the average value H is more preferably 16 μm and even more preferably 14 μm, from the viewpoint of more thoroughly saturating the recesses 32, 34 with the molten alloy. The lower limit for the average value H is more preferably 8.5 μm and even more preferably 8.7 μm, from the viewpoint of obtaining $R_2T_{14}B$ phase crystals with sufficiently high adhesiveness between the molten alloy and the roll surface 17, while also having more uniform orientation in the thickness direction of the alloy strip.

The average value W of the spacing between raised sections 36 is 40 to 100 μm. The upper limit for the average value W is preferably 80 μm, more preferably 70 μm and even more preferably 67 μm, from the viewpoint of further reducing the widths of the $R_2T_{14}B$ phase columnar crystals and obtaining magnet powder with a small particle diameter. The lower limit for the average value W is preferably 45 μm and more preferably 48 μm. This will allow an R-T-B sintered magnet to be obtained having even higher magnetic properties.

When the molten alloy 13 has been poured onto the roll surface 17 of the cooling roll 16, the molten alloy 13 contacts with the raised sections 36 first. Crystal nuclei 1 are generated at the contact sections, and the crystal nuclei 1 serve as origins for columnar growth of crystal grains 2 comprising a $R_2T_{14}B$ phase. By generating numerous such crystal nuclei 1 to increase the number of crystal nuclei 1 per unit area, growth of the $R_2T_{14}B$ phase along the roll surface 17 is inhibited, and it is possible to obtain an R-T-B alloy strip with small spacing M, as shown in FIG. 3.

The average value for the spacings a and b is preferably 40 to 100 μm. Consequently, it is possible to obtain an R-T-B alloy strip having small spacing M between the grain boundary regions 4 and reduced variation in the spacing M. Incidentally, it is not easy to form recesses 32, 34 having spacings with an average value of 40 μm or smaller. The alloy that has cooled on the cooling surface of the cooling roll may be further cooled with a common secondary cooling section.

The cooling rate is preferably 1000° C. to 3000° C./sec and more preferably 1500° C. to 2500° C./sec, from the viewpoint of adequately micronizing the structure of the obtained alloy strip while inhibiting generation of heterophases. If the cooling rate is below 1000° C./sec, an α-Fe phase will tend to be readily deposited, and if the cooling rate exceeds 3000° C./sec, chill crystals will tend to be readily deposited. Chill crystals are isotropic microcrystals with particle diameters of 1 μm and smaller. High generation of chill crystals tends to impair the magnetic properties of the finally obtained R-T-B sintered magnet.

Cooling with the cooling roll may be followed by secondary cooling in which cooling is carried out by a method such as blowing gas. There are no particular restrictions on the method of secondary cooling, and any conventional cooling method may be employed. For example, it may be one provided with a gas tube 19 having a gas blow hole 19*a*, wherein cooling gas is blown through the gas blow hole 19*a* onto the alloy strip accumulated on a rotating table 20 rotating in the circumferential direction. The alloy strip 18 can be sufficiently cooled in this manner. The alloy strip is recovered after sufficient cooling with the secondary cooling section 20. It is thus possible to produce an R-T-B alloy strip having a cross-sectional structure such as shown in FIG. 3.

The thickness of the R-T-B alloy strip of this embodiment is preferably no greater than 0.5 mm and more preferably 0.1 to 0.5 mm. If the thickness of the alloy strip becomes too large, the difference in cooling rate will tend to roughen the structure of the crystal grains 2 and impair the homogeneity. Also, the structure near the surface on the roll surface side (the casting surface) and the structure near the surface on the side opposite the casting surface (the free surface) of the alloy strip will differ, and the difference between $D_1$ and $D_2$ will tend to increase.

Figure 8:
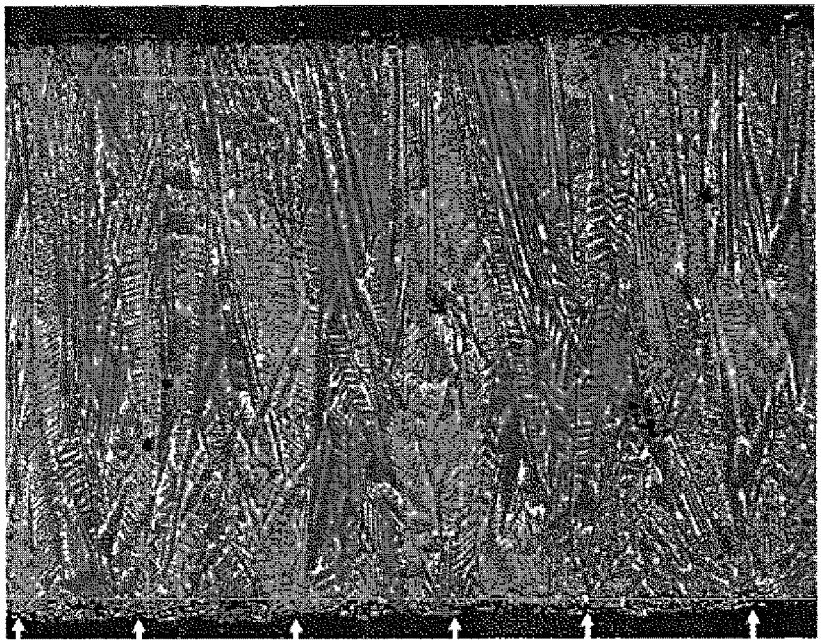
FIG. 8 is a pair of SEM-BEI images (magnification: 350×) showing examples of cross-sections of an R-T-B alloy strip to be used for production of an R-T-B sintered magnet of the invention, along the thickness direction.
Figure 8:
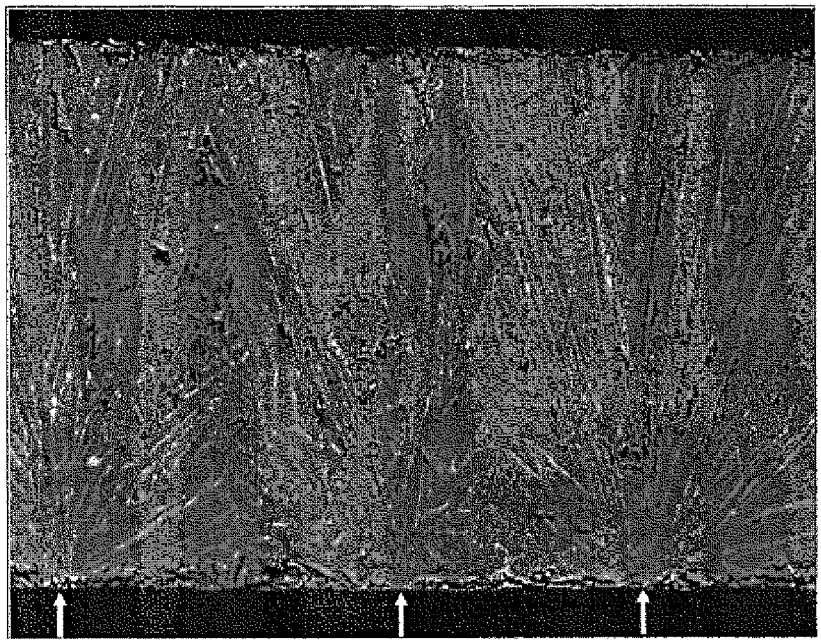

FIG. 8 is an SEM-BEI image showing a cross-section of an R-T-B alloy strip in the thickness direction. FIG. 8(A) is an SEM-BEI image (magnification: 350×) showing a cross-section along the thickness direction of an R-T-B alloy strip prepared by the production method of this embodiment. Also, FIG. 8(B) is an SEM-BEI image (magnification: 350×) showing a cross-section in the thickness direction of an R-T-B alloy strip prepared by a conventional production method. In FIGS. 8(A) and (B), the lower side surface of the R-T-B alloy strip is the contact surface with the roll surface (casting surface). Also, in FIGS. 8(A) and (B) the deep-colored sections represent $R_2T_{14}B$ phases and the light-colored sections represent R-rich phases.

As shown in FIG. 8(A), the R-T-B alloy strip prepared by the production method of this embodiment has the crystal nuclei of numerous $R_2T_{14}B$ phases deposited on the lower surface (see the arrows in the drawing). In addition, $R_2T_{14}B$ phase crystal grains extend in a radial fashion from the crystal nuclei in the upward direction of FIG. 8(A), i.e. along the thickness direction.

On the other hand, as shown in FIG. 8(B), the R-T-B alloy strip prepared by a conventional production method has less deposition of $R_2T_{14}B$ phase crystal nuclei than in FIG. 8(A). In addition, the $R_2T_{14}B$ phase crystals grow not only in the up-down direction but also in the left-right direction. Therefore, the lengths (widths) of the $R_2T_{14}B$ phase crystal grains in the direction perpendicular to the thickness direction are increased compared to FIG. 8(A). If the R-T-B alloy strip has such a structure, it will not be possible to obtain alloy powder that is micronized and has excellent homogeneity of shape and size.

Figure 9:
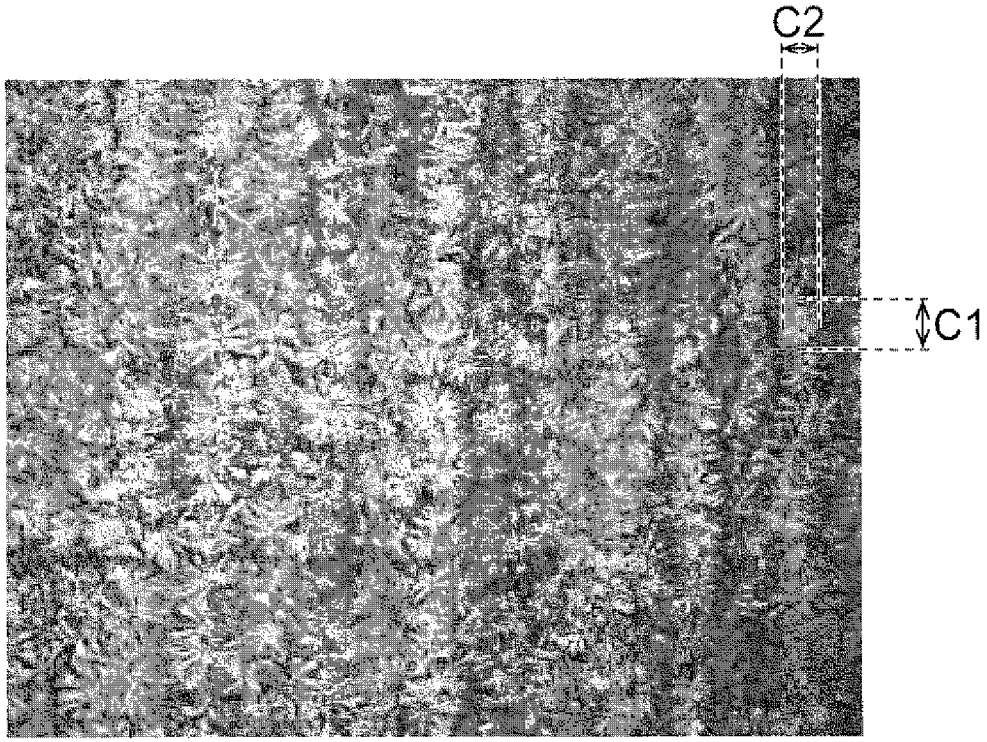
FIG. 9 is a metallographic microscope image (magnification: 100×) of one surface of an R-T-B alloy strip to be used for production of an R-T-B sintered magnet of the invention.

FIG. 9 is a metallographic microscope image (magnification: 100×) of one surface of an R-T-B alloy strip prepared by the production method of this embodiment. One surface of the R-T-B metal foil strip prepared by the production method of this embodiment is composed of a plurality of petal-like dendritic crystals containing an $R_2T_{14}B$ phase, as shown in FIG. 9. FIG. 9 is a metallographic microscope image of the surface of the R-T-B alloy strip, taken from the side having crystal nuclei 1 in FIG. 3.

Figure 10:
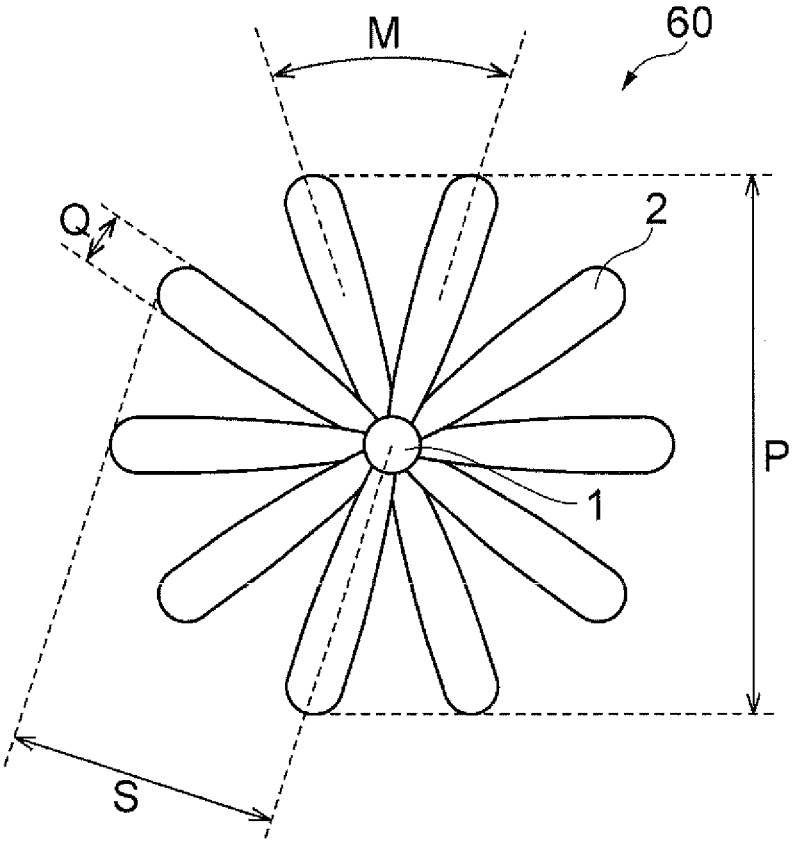
FIG. 10 is a plan view schematically showing dendritic crystals in an R-T-B alloy strip to be used for production of an R-T-B sintered magnet according to the invention.

FIG. 10 is an enlarged plan view schematically showing a dendritic crystal composing one surface of an R-T-B alloy strip prepared by the production method of this embodiment. The dendritic crystal 60 has a crystal nucleus 1 at the center section, and filler-shaped crystal grains 2 extending in a radial fashion from the crystal nucleus 1 as the origin.

As shown in FIG. 9, the dendritic crystals 60 lie in one direction overall (the up-down direction in FIG. 1) on one surface of the R-T-B alloy strip, forming a crystal group. The aspect ratio is calculated as C2/C1, where C1 is the lengths of the long axes of the crystal group of the dendritic crystals and C2 is the lengths of the short axes perpendicular to the long axes, as seen in FIG. 9. The average value for the aspect ratio calculated in this manner is preferably 0.8 or greater, more preferably 0.7 to 1.0, even more preferably 0.8 to 0.98 and most preferably 0.88 to 0.97. If the average value of the aspect ratio is within this range, the homogeneity of the shapes of the dendritic crystals 60 will be increased, and growth of the $R_2T_{14}B$ phase in the thickness direction of the alloy strip will be more uniform. Also, by limiting the widths of the dendritic crystals 60 to within the range specified above, it is possible to obtain an alloy strip that is even more micronized and has a uniformly dispersed R-rich phase. It will thus be possible to obtain alloy powder with small particle diameters and low particle diameter variation. The average value for the aspect ratio of the crystal group of the dendritic crystals 60 is the arithmetic mean value for the ratio (C2/C1) for 100 arbitrarily selected crystal groups.

The surfaces of the R-T-B alloy strips shown in FIGS. 9 and 10 have more crystal nuclei 1 per unit area on one surface, and smaller widths P of the dendritic crystals 60, compared to the surfaces of a conventional R-T-B alloy strip. In addition, the spacing M between filler-like crystal grains 2 composing the dendritic crystal 60 is smaller and the sizes of the filler-like crystal grains 2 are also smaller. Specifically, the surface of the R-T-B alloy strip of this embodiment is composed of dendritic crystals 60 that are fine and have limited size variation. The homogeneity of the dendritic crystals 60 is thus significantly improved. Also, the variation in the size of the length S and width Q of filler-like crystal grains 2 on the surface of the R-T-B alloy strip is also significantly reduced.

(Second Step)

In the second step, the R-T-B alloy strip is ground to a particulate form. Grinding of the starting alloy is preferably carried out in two stages, with a coarse grinding step and fine grinding step. The coarse grinding step is carried out in an inert gas atmosphere using, for example, a stamp mill, jaw crusher, Braun mill or the like. Also, from the viewpoint of lowering the oxygen concentration in the obtained R-T-B sintered magnet 10 to obtain satisfactory magnetic properties, it is preferred to carry out hydrogen storage grinding, wherein hydrogen is stored in the starting alloy and the generation of cracks due to volume expansion is utilized for grinding. In the coarse grinding step, the starting alloy is ground to a particle diameter of about several hundred μm.

In the subsequent fine grinding step following the coarse grinding step, the ground product obtained from the coarse grinding step is subjected to fine grinding to a mean particle diameter of 3 to 5 μm, to obtain an alloy powder (alloy fine powder). The fine grinding may be carried out using a jet mill, for example. In the second step, the alloy strip grain boundary region 4 sections undergo fracturing preferentially. Consequently, the particle diameters of the alloy powder depend on the spacing of the grain boundary regions 4. The alloy strip to be used in the production method of this embodiment has smaller spacing M between the grain boundary regions 4, and lower variation thereof, than in the prior art, as shown in FIG. 3, and therefore by grinding it is possible to obtain an alloy powder having a small particle diameter and sufficiently reduced variation in size and shape.

(Third Step)

The third step is a step in which the alloy powder is molded and fired in a magnetic field to produce an R-T-B sintered magnet comprising an $R_2T_{14}B$ phase and containing no dysprosium. In this step, first the alloy powder is molded in a magnetic field to obtain a compact. Specifically, first the alloy powder is packed into a die situated in an electromagnet. A magnetic field is then applied by the electromagnet and the alloy powder is pressed while orienting the crystal axes of the alloy powder. Molding is thus carried out in a magnetic field to prepare a compact. The molding in a magnetic field may be carried out in a magnetic field of 12.0 to 17.0 kOe, for example, at a pressure of about 0.7 to 1.5 ton/cm$^2$.

Next, the compact obtained by the magnetic field molding is fired in a vacuum or in an inert gas atmosphere to obtain a sintered compact. The firing conditions are preferably set as appropriate for the conditions including the composition, the grinding method and the particle size. For example, the firing temperature may be set to 1000° C. to 1100° C. for a firing time of 1 to 6 hours.

Since the R-T-B sintered magnet obtained by the production method of this embodiment employs an alloy powder comprising crystal grains 2 containing a $R_2T_{14}B$ phase, that are sufficiently micronized and have sufficiently reduced size variation, it can yield an R-T-B sintered magnet with a more micronized and homogeneous structure than the prior art. Such an R-T-B sintered magnet has a small average value for the area of the triple point region 14, and low standard deviation for the area distribution. This may therefore be considered to be a preferred production method for the R-T-B sintered magnet 10 described above. Furthermore, since essentially no Dy source is used as starting material, the R-T-B sintered magnet contains essentially no Dy. According to the production method of this embodiment, therefore, it is possible to produce an R-T-B sintered magnet that can exhibit a very high level for both high magnetic properties and excellent corrosion resistance.

The R-T-B sintered magnet obtained by the process described above may also be subjected to aging treatment if necessary. By carrying out aging treatment, it is possible to further increase the coercive force of the R-T-B sintered magnet. Aging treatment is preferably carried out in two stages, for example, under two different temperature conditions such as near 800° C. and near 600° C. Aging treatment under such conditions will tend to result in particularly excellent coercive force. When aging treatment is carried out in a single step, it is preferably at a temperature of near 600° C.

A preferred embodiment of a rotary machine (motor) comprising the R-T-B sintered magnet 10 of this embodiment will now be described.

Figure 11:
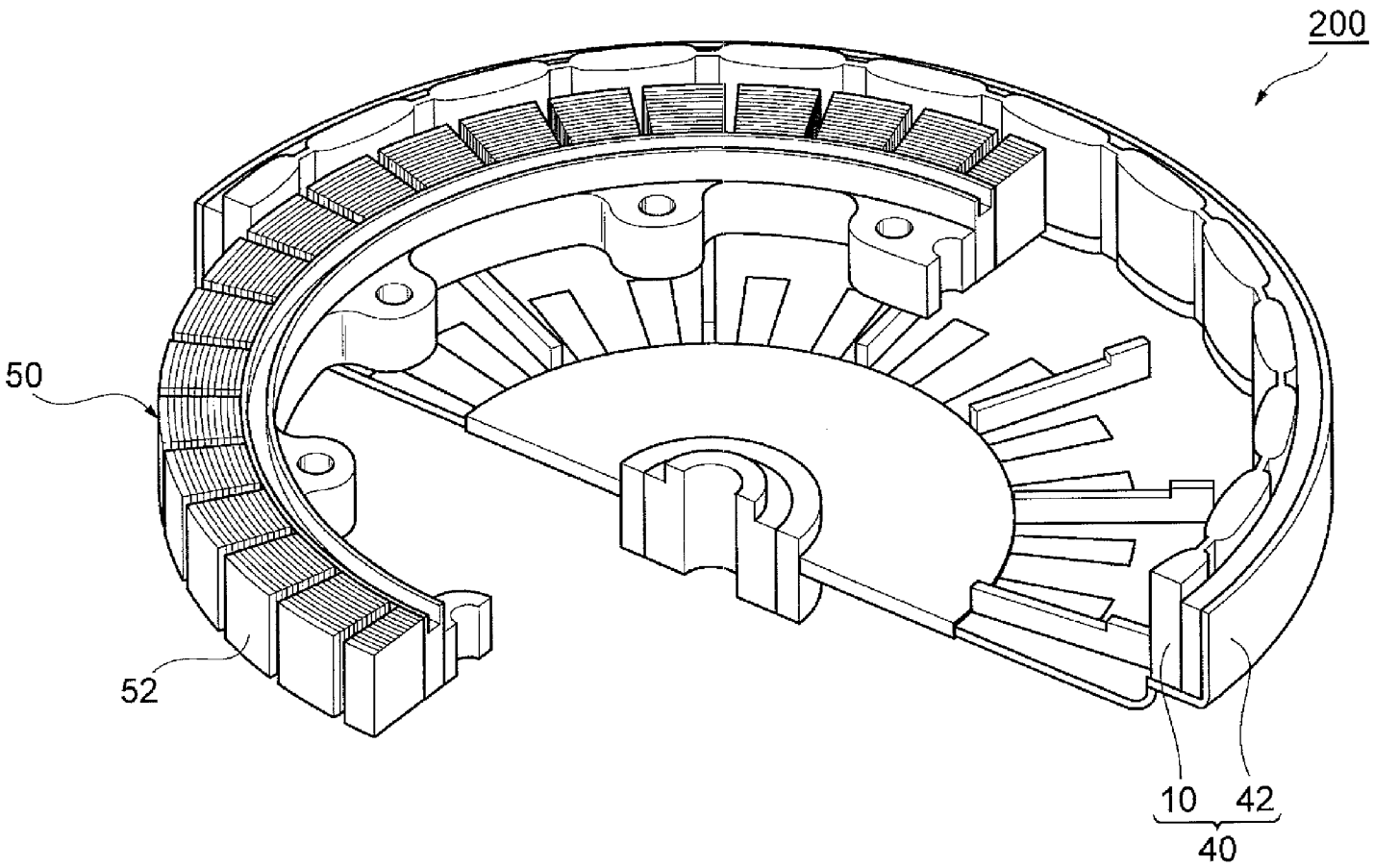
FIG. 11 is an illustration of the internal structure of a preferred embodiment of a motor according to the invention.

FIG. 11 is an illustration of the internal structure of a motor according to a preferred embodiment. The motor 200 shown in FIG. 11 is a permanent magnet synchronous motor (SPM motor 200), comprising a cylindrical rotor 40 and a stator 50 situated on the inside of the rotor 40. The rotor 40 has a cylindrical core 42 and a plurality of R-T-B sintered magnets 10 oriented with the N-poles and S-poles alternating along the inner peripheral surface of the cylindrical core 42. The stator 50 has a plurality of coils 52 provided along the outer peripheral surface. The coils 52 and R-T-B sintered magnets 10 are arranged in a mutually opposing fashion.

The SPM motor 200 is provided with R-T-B sintered magnets 10 according to the embodiment described above, in the rotor 40. The R-T-B sintered magnets 10 exhibit high levels in terms of both high magnetic properties and excellent corrosion resistance. Thus, the SPM motor 200 comprising the R-T-B sintered magnets 10 can continuously exhibit high output for prolonged periods.

Preferred embodiments of the invention were described above, but the invention is not limited to these embodiments.

EXAMPLES

The invention will now be explained in greater detail by way of examples and comparative examples, with the understanding that the invention is not limited to the examples.

Example 1

Fabrication of Alloy Strip

An apparatus for production of an alloy strip as shown in FIG. 4 was used for a strip casting method by the following procedure. First, the starting compounds for each of the constituent elements were added so that the composition of the alloy strip had the elemental ratios (mass %) shown in Table 1, and heated to 1300° C. with a high-frequency melting furnace 11, to prepare a molten alloy 12 having an R-T-B based composition. The molten alloy 12 was poured onto the roll surface 17 of the cooling roll 16 rotating at a prescribed speed through a tundish. The cooling rate of the molten alloy 12 on the roll surface 17 was 1800° C. to 2200° C./sec.

The roll surface 17 of the cooling roll 16 had a concavo-convex pattern comprising straight linear first recesses 32 extending along the rotational direction of the cooling roll 16, and straight linear second recesses 34 perpendicular to the first recesses 32. The average value H for the heights of the raised sections 36, the average value W for the spacings between the raised sections 36, and the surface roughness Rz, were as shown in Table 2. Measurement of the surface roughness Rz was carried out using a measuring apparatus by Mitsutoyo Corp. (trade name: SURFTEST).

The alloy strip obtained by cooling with the cooling roll 16 was further cooled with a secondary cooling section 20 to obtain an alloy strip having an R-T-B based composition. The composition of the alloy strip was as shown in Table 1.

<Evaluation of Alloy Strip>

An SEM-BEI image was taken of a cross-section along the thickness direction of the obtained alloy strip (magnification: 350×). The thickness of the alloy strip was determined from the image. The thickness was as shown in Table 2.

In addition, SEM-BEI images of cross-sections along the thickness direction of the alloy strip were for 15 visual fields on the casting surface side, the free surface side and at the center section, for a total of 45 SEM-BEI images (magnification: 1000×). Using the images, 0.15 mm straight lines were drawn to a position 50 μm on the center section side from the casting surface, a position 50 μm on the center section side from the free surface, and to the center section. The values of $D_1$, $D_2$ and $D_3$ were determined from the lengths of the straight lines and the number of crystal grains transected by the straight lines.

Incidentally, $D_1$ is the average value for the lengths of the crystal grains on the casting surface side in the direction perpendicular to the thickness direction, $D_2$ is the average value for the lengths of the crystal grains on the free surface side in the direction perpendicular to the thickness direction, and $D_3$ is the average value for the lengths of the crystal grains at the center section in the direction perpendicular to the thickness direction. The average value $D_{AVE}$ was calculated for $D_1$, $D_2$ and $D_3$. Also, $D_{MAX}$ was the value in the image with the maximum crystal grain length among the crystal grain lengths in the direction perpendicular to the thickness direction in the 45 images. The measurement results were as shown in Table 2.

Also, the 45 SEM-BEI images were used to determine the percentage a of the number of R-rich phases with lengths of up to 1.5 μm on the straight line, with respect to the total number of R-rich phases through which the straight line crossed. The results were as shown in Table 2.

The casting surface of an alloy strip such as shown in FIG. 9 was observed using a metallographic microscope (magnification: 100×), to determine the average value for the widths P of the dendritic crystals (FIG. 10), the ratio of the lengths C2 of the short axes with respect to the lengths C1 of the long axes of the dendritic crystal groups (aspect ratio), the area occupancy of the $R_2T_{14}B$ phase crystals with respect to the total visual field, and the number of dendritic crystal nuclei generated per unit area (1 $mm^2$). The results are shown in Table 3. The area occupancy of the $R_2T_{14}B$ phase crystals is the area ratio of dendritic crystals with respect to the total image, in a metallographic microscope image of the casting surface of an R-T-B alloy strip such as shown in FIG. 9. In FIG. 9, the dendritic crystals correspond to the white sections. The average value for the crystal group aspect ratio in Table 3 is the arithmetic mean value for the ratio (C2/C1) for 100 arbitrarily selected crystal groups.

<Production of R-T-B Sintered Magnet>

An R-T-B sintered magnet was then produced by the following procedure, using the obtained alloy strip. First, hydrogen was stored in the obtained alloy strip at room temperature, and then dehydrogenation treatment was carried out at 600° C. for 1 hour in argon gas atmosphere to obtain hydrogen-pulverized powder. Oleic acid amide was added at 0.1 wt % to the hydrogen-pulverized powder as a grinding aid, and mixed therewith. Next, an inert gas was used for grinding with a jet mill to obtain alloy powder with a particle diameter of 2 to 3 μm. The particle diameter of the alloy powder was controlled using a rotor-type classifier in the pulverizer.

The alloy powder was packed into a die situated in an electromagnet, and molded in a magnetic field to produce a compact. The molding was accomplished by pressing at 1.2 ton/$cm^2$ while applying a magnetic field of 15 kOe. The compact was then fired at 930° C. to 1030° C. for 4 hours in a vacuum and rapidly cooled to obtain a sintered compact. The obtained sintered compact was subjected to two-stage aging treatment at 800° C. for 1 hour and at 540° C. for 1 hour (both in an argon gas atmosphere), to obtain an R-T-B sintered magnet for Example 1.

<Evaluation of R-T-B Sintered Magnet>

A B—H tracer was used to measure the Br (residual flux density) and HcJ (coercive force) of the obtained R-T-B sintered magnet. The measurement results are shown in Table 3. Also, the mean particle diameter was determined for the particles containing the $R_2T_{14}B$ phase in the R-T-B sintered magnet. Specifically, a cut surface of the R-T-B sintered magnet was polished, and then a metallographic microscope was used for observation of an image of the polished surface (magnification: 1600×). Also, the shapes of the crystal grains of the $R_2T_{14}B$ phase were identified by image analysis, and the diameters of the individual particles were measured, recording the arithmetic mean value of the measured values as the mean particle diameter. The values of the mean particle diameters are shown in Table 3.

Examples 2 to 12

R-T-B alloy strips for Examples 1 to 12 were obtained in the same manner as Example 1, except that the roll surface of the cooling roll was worked to change the average value H for the heights of the raised sections, the average value W for the spacings between the raised sections and the surface roughness Rz, as shown in Table 2, and the starting materials were changed to change the compositions of the alloy strip as shown in Table 1. The alloy strips of Examples 2 to 12 were evaluated in the same manner as Example 1. Also, R-T-B sintered magnets for Examples 2 to 12 were fabricated in the same manner as Example 1 and evaluated. The results are shown in Tables 2 and 3.

Based on results of image observation with a metallographic microscope, the R-T-B alloy strips used in each of the examples had the dendritic $R_2T_{14}B$ phase crystal grains on the surface. Also, generation of numerous dendritic crystal nuclei was confirmed.

Figure 12:
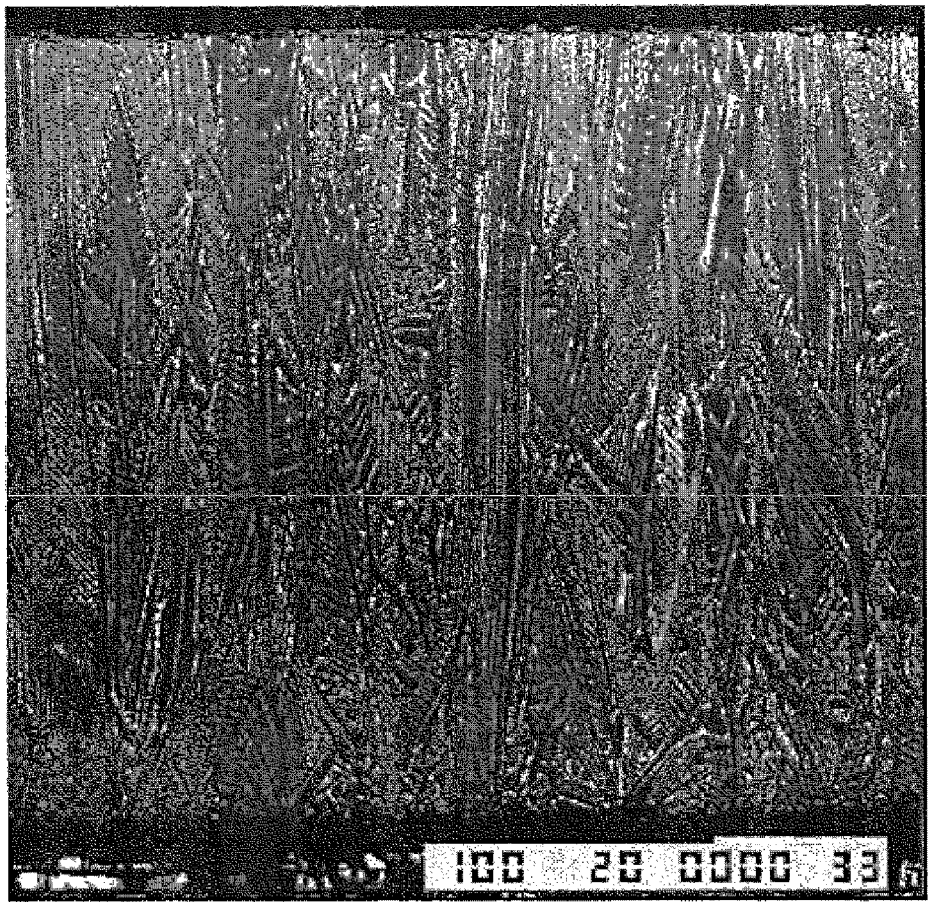
FIG. 12 is an SEM-BEI image (magnification: 350×) of a cross-section of the R-T-B alloy strip used in Example 6, along the thickness direction.
Figure 13:
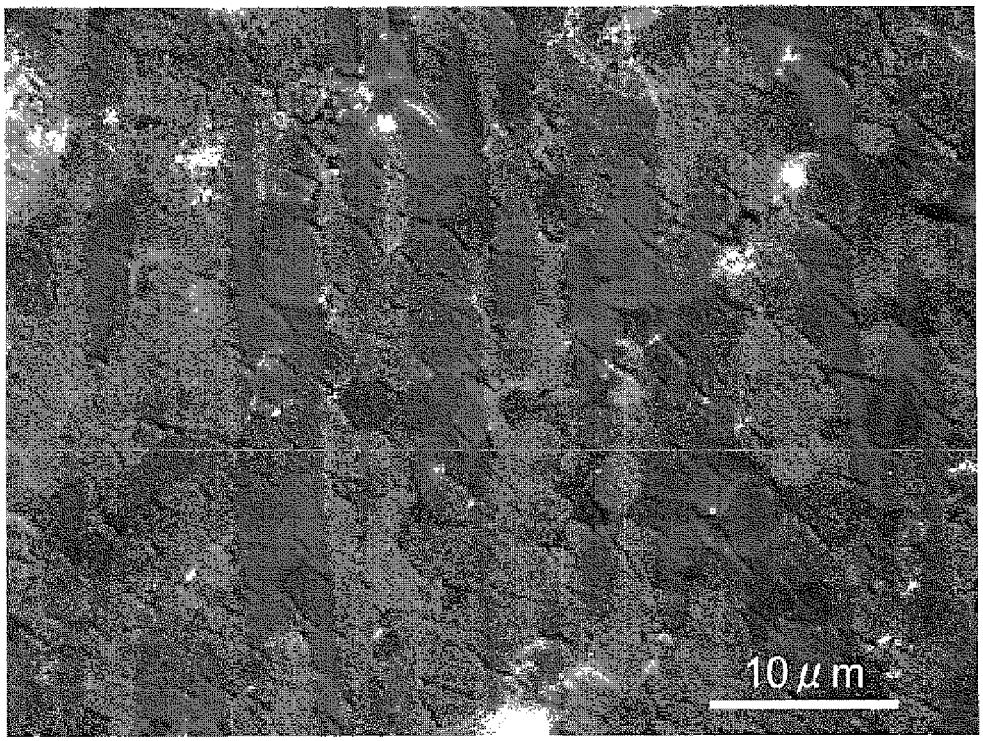
FIG. 13 is a metallographic microscope image (magnification: 1600×) of a cross-section of the R-T-B sintered magnet of Example 6.
Figure 14:
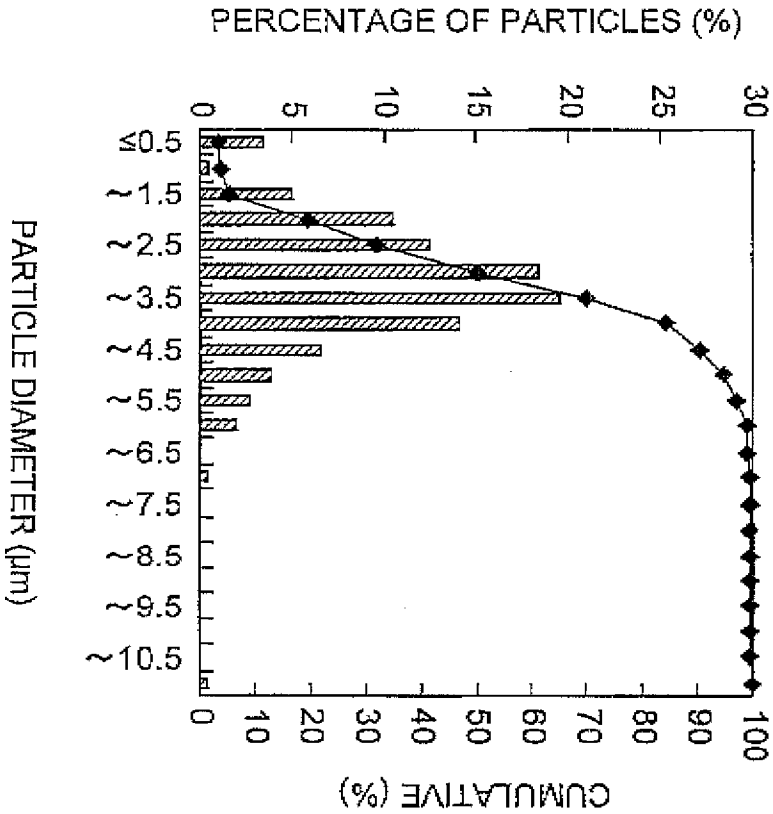
FIG. 14 is a graph showing particle diameter distribution for particles containing a $R_2T_{14}B$ phase in the R-T-B sintered magnet of Example 6.

FIG. 12 is an SEM-BEI image (magnification: 350×) of a cross-section of the R-T-B alloy strip of Example 6, along the thickness direction. FIG. 13 is an optical microscope image of a cross-section of the R-T-B sintered magnet of Example 6, and FIG. 14 is a graph showing particle diameter distribution for $R_2T_{14}B$ phase particles in the cross-section. As clearly seen from FIGS. 13 and 14, it was confirmed that the particle diameters of the crystal grains of the R-T-B sintered magnet of Example 5 were sufficiently small and the variation in particle diameter and shape was low. This is because, as shown in FIG. 12, an R-T-B alloy strip was used comprising $R_2T_{14}B$ phase crystal grains with minimal diffusion in the direction perpendicular to the thickness direction, in a cross-section along the thickness direction. In other words, by using such an R-T-B alloy strip, variation in the particle diameters and shapes of the alloy powder obtained by grinding is sufficiently reduced, and it is therefore possible to obtain an R-T-B sintered magnet with increased homogeneity of structure.

Comparative Example 1

An R-T-B alloy strip was obtained for Comparative Example 1 in the same manner as Example 1, except that the starting materials were changed to change the composition of the alloy strip as shown in Table 1, and there were used cooling rolls having only straight linear first recesses on the roll surfaces extending in the rotational direction of the rolls. These cooling rolls did not have second recesses. The average value H for the heights of the raised sections, the average value W for the spacings between the raised sections and the surface roughness Rz, for the cooling rolls, were determined by the following procedure. Specifically, the cross-sectional structure near the roll surface was observed with a scanning electron microscope at the cut surface, when the cooling roll was cut on a plane parallel to the axial direction running through the axis of the cooling roll. The average value H for the heights of the raised sections is the arithmetic mean value for the heights of 100 raised sections, and the average value W for the spacings between the raised sections is the arithmetic mean value for the values of spacings between adjacent raised sections measured at 100 different locations.

The alloy strip of Comparative Example 1 was evaluated in the same manner as Example 1. An R-T-B sintered magnet for Comparative Example 1 was fabricated in the same manner as Example 1 and evaluated. The results are shown in Tables 2 and 3.

Comparative Examples 2 and 3

R-T-B alloy strips for Comparative Examples 2 and 3 were obtained in the same manner as Example 1, except that the starting materials were changed to change the compositions of the alloy strip as shown in Table 1, and the roll surfaces of the cooling rolls were worked to change the average value H for the heights of the raised sections, the average value W for the spacings between the raised sections and the surface roughness Rz, as shown in Table 2. The alloy strips of Comparative Examples 2 and 3 were evaluated in the same manner as Example 1. R-T-B sintered magnets for Comparative Examples 2 and 3 were fabricated in the same manner as Example 1 and evaluated. The results are shown in Tables 2 and 3.

Figure 15:
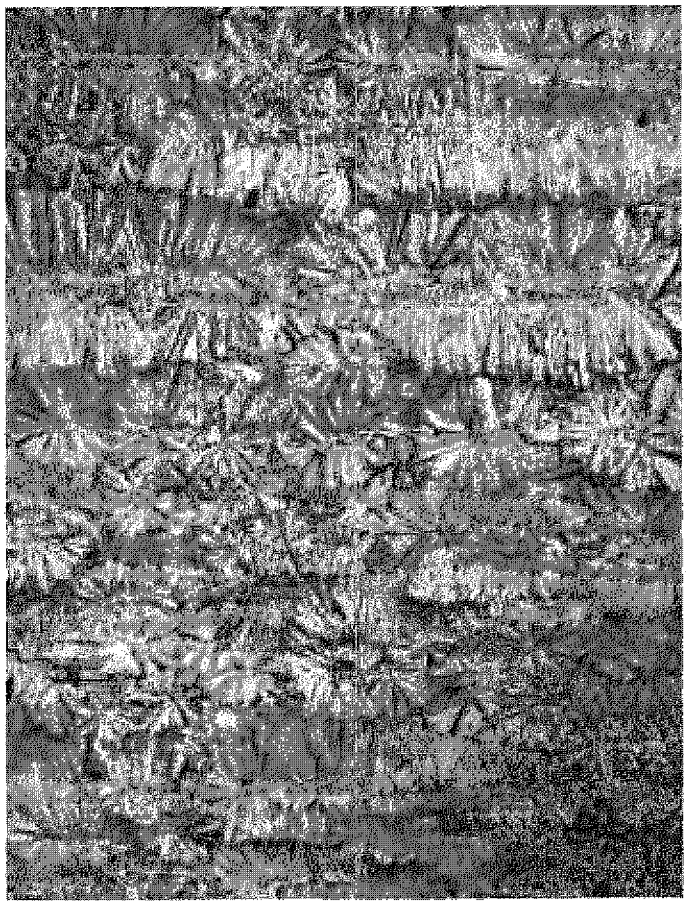
FIG. 15 is a metallographic microscope image (magnification: 100×) of one surface of the R-T-B alloy strip used in Comparative Example 1.
Figure 16:
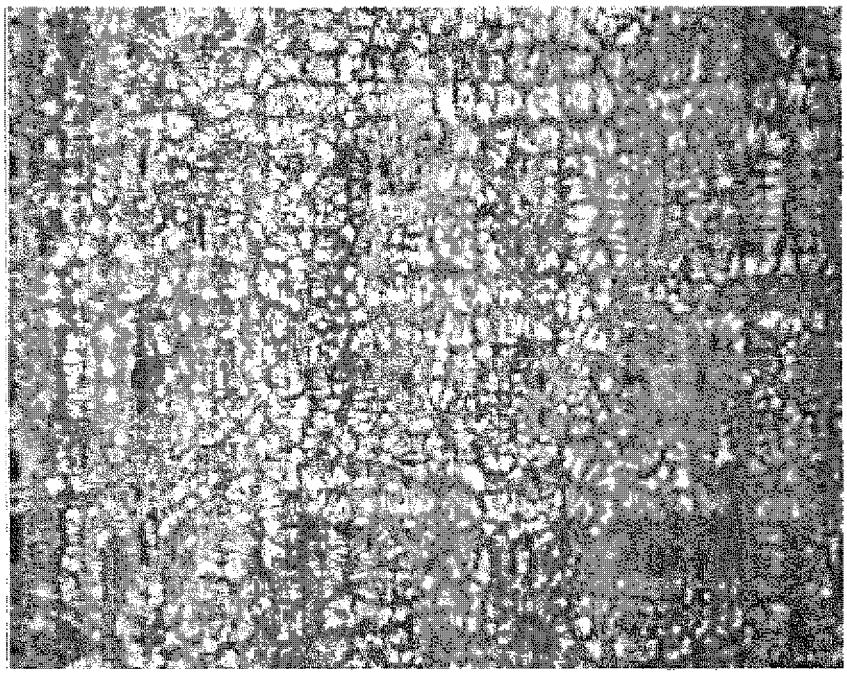
FIG. 16 is a metallographic microscope image (magnification: 100×) of one surface of the R-T-B alloy strip used in Comparative Example 2.
Figure 17:
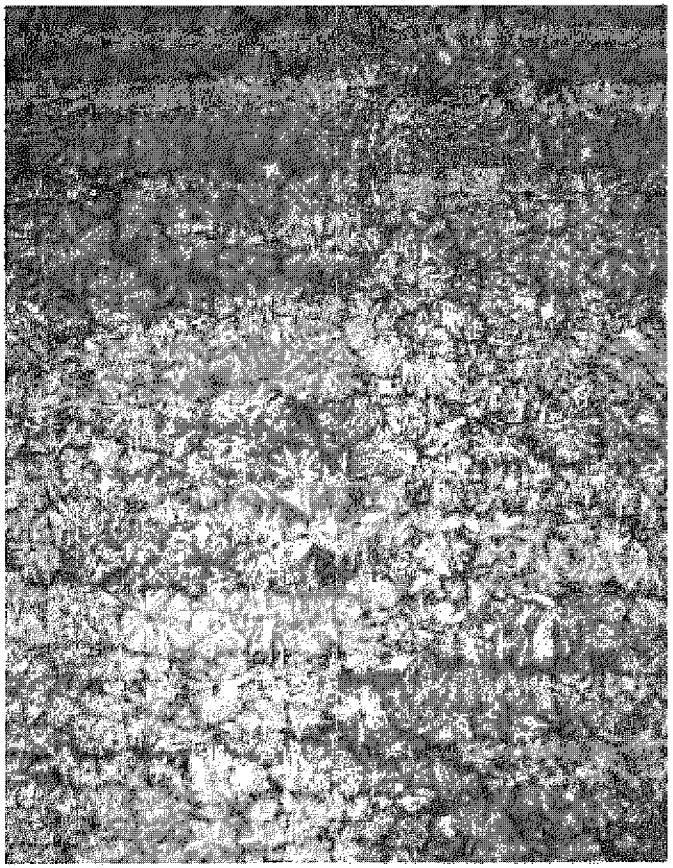
FIG. 17 is a metallographic microscope image (magnification: 100×) of one surface of the R-T-B alloy strip used in Comparative Example 3.
Figure 18:
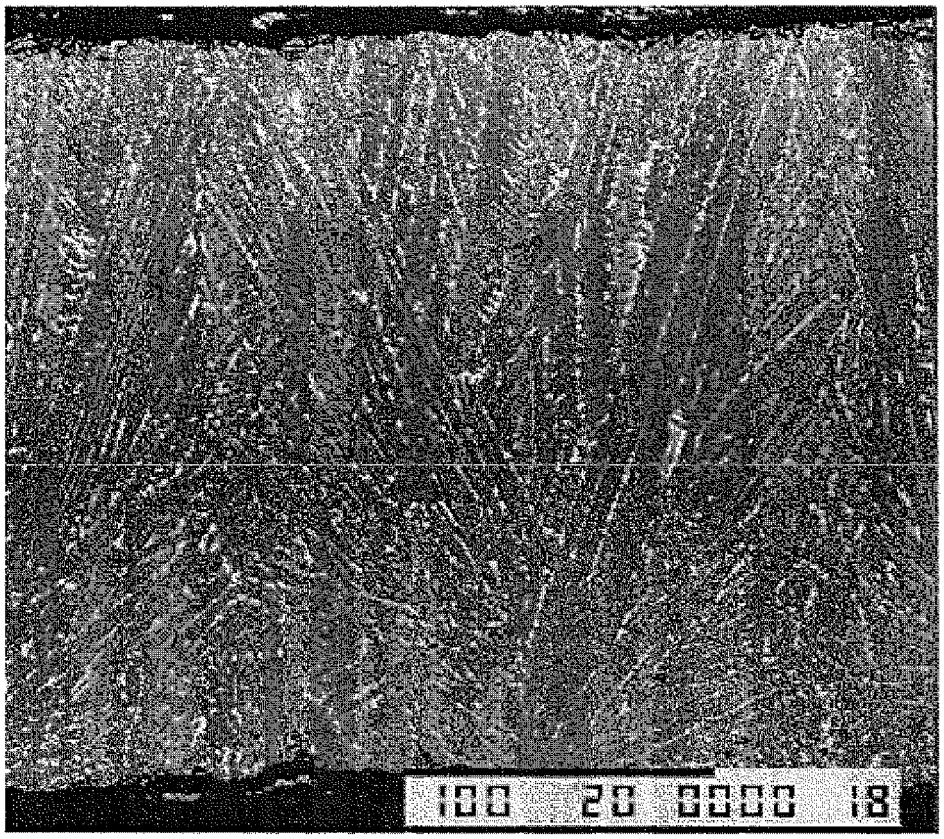
FIG. 18 is a metallographic microscope image (magnification: 100×) of one surface of the R-T-B alloy strip used in Comparative Example 3.

FIGS. 15, 16 and 17 are each metallographic microscope images (magnification: 100×) of one surface of the R-T-B alloy strips used in Comparative Examples 1, 2 and 3, respectively. FIG. 18 is an SEM-BEI image (magnification: 350×) of a cross-section of the R-T-B alloy strip used in Comparative Example 3, along the thickness direction. Based on the metallographic microscope images of FIGS. 15 to 17 it was confirmed that either dendritic crystal grains were not formed on the surfaces of the R-T-B alloy strips used in the comparative examples, or even if formed, the individual crystal nuclei were large and non-homogeneous.

Comparative Examples 4 and 5

An R-T-B alloy strip was obtained for Comparative Examples 4 and 5 in the same manner as Example 1, except that the starting materials were changed to change the composition of the alloy strip as shown in Table 1, and there was used a cooling roll having only straight linear first recesses on the roll surface extending in the rotational direction of the roll. These cooling rolls did not have second recesses. The average value H for the heights of the raised sections, the average value W for the spacings between the raised sections and the surface roughness Rz, for the cooling rolls, were determined in the same manner as Comparative Example 1. The alloy strip of Comparative Example 5 was evaluated in the same manner as Example 1. R-T-B sintered magnets for Comparative Examples 4 and 5 were fabricated in the same manner as Example 1 and evaluated. The results are shown in Table 3.

TABLE 1

| | Contents of elements in R-T-B alloy strip, based on mass (mass %) | | | | | | | | | | | |
|---|---|---|---|---|---|---|---|---|---|---|---|---|
| | Nd | Pr | Dy | Tb | Ho | Co | Cu | Al | Ga | Zr | B | Fe |
| Example 1 | 25.00 | 6.00 | 0.00 | 0.00 | 0.00 | 0.50 | 0.10 | 0.20 | 0.10 | 0.20 | 1.00 | 66.90 |
| Example 2 | 31.20 | 0.00 | 0.00 | 0.00 | 0.00 | 1.00 | 0.10 | 0.20 | 0.10 | 0.10 | 1.02 | 66.28 |
| Example 3 | 28.10 | 3.10 | 0.00 | 0.00 | 0.00 | 1.10 | 0.10 | 0.20 | 0.10 | 0.10 | 0.98 | 66.22 |
| Example 4 | 22.40 | 8.90 | 0.00 | 0.00 | 0.00 | 1.00 | 0.10 | 0.20 | 0.00 | 0.10 | 0.99 | 66.31 |
| Example 5 | 28.30 | 5.80 | 0.00 | 0.00 | 0.00 | 0.50 | 0.20 | 0.10 | 0.30 | 0.20 | 1.03 | 63.57 |
| Example 6 | 31.00 | 0.00 | 0.00 | 0.00 | 0.00 | 1.00 | 0.10 | 0.20 | 0.00 | 0.20 | 0.98 | 66.52 |
| Example 7 | 34.70 | 0.00 | 0.00 | 0.00 | 0.00 | 1.00 | 0.10 | 0.20 | 0.00 | 0.20 | 0.98 | 62.82 |
| Example 8 | 34.00 | 0.00 | 0.00 | 0.00 | 0.00 | 1.00 | 0.10 | 0.20 | 0.00 | 0.20 | 1.03 | 63.47 |
| Example 9 | 29.50 | 0.00 | 0.00 | 0.00 | 0.00 | 0.50 | 0.10 | 0.20 | 0.00 | 0.06 | 0.90 | 68.74 |
| Example 10 | 29.50 | 0.00 | 0.00 | 0.00 | 0.00 | 0.50 | 0.20 | 0.20 | 0.00 | 0.20 | 0.91 | 68.49 |
| Example 11 | 28.30 | 0.00 | 0.00 | 0.00 | 0.00 | 1.00 | 0.10 | 0.20 | 0.00 | 0.20 | 1.10 | 69.10 |
| Example 12 | 28.30 | 0.00 | 0.00 | 0.00 | 0.00 | 2.80 | 0.10 | 0.20 | 0.00 | 0.20 | 1.00 | 67.40 |
| Comp. Ex. 1 | 31.00 | 0.00 | 0.00 | 0.00 | 0.00 | 1.00 | 0.10 | 0.20 | 0.00 | 0.20 | 0.98 | 66.52 |
| Comp. Ex. 2 | 31.00 | 0.00 | 0.00 | 0.00 | 0.00 | 1.00 | 0.10 | 0.20 | 0.00 | 0.20 | 0.98 | 66.52 |
| Comp. Ex. 3 | 31.00 | 0.00 | 0.00 | 0.00 | 0.00 | 1.00 | 0.10 | 0.20 | 0.00 | 0.20 | 0.98 | 66.52 |
| Comp. Ex. 4 | 23.20 | 5.80 | 2.10 | 0.00 | 0.00 | 1.00 | 0.10 | 0.20 | 0.00 | 0.20 | 1.00 | 66.40 |
| Comp. Ex. 5 | 25.00 | 6.00 | 0.00 | 0.00 | 0.00 | 0.50 | 0.10 | 0.20 | 0.10 | 0.20 | 1.00 | 66.90 |

Units of values in the table are mass %.

Values for Fe include unavoidable impurities.

TABLE 2

| | Cooling roll surface | | | | | Cross-section along thickness direction of alloy strip | | | | | | Percentage |
|---|---|---|---|---|---|---|---|---|---|---|---|---|
| | Concavo-convex pattern | Surface roughness (Rz) μm | Raised section height (mean value H) μm | Raised section spacing (mean value W) μm | Alloy strip Thickness mm | $D_{AVE}$ μm | $D_{MAX}$ μm | $D_1$ μm | $D_2$ μm | $D_3$ μm | $D_2/D_1$ | α % |
| Example 1 | Perpendicular | 4.4 | 10.2 | 62 | 0.26 | 2.36 | 3.03 | 2.23 | 2.42 | 2.42 | 1.09 | 93 |
| Example 2 | Perpendicular | 4.3 | 10.5 | 57 | 0.24 | 2.41 | 3.14 | 2.28 | 2.48 | 2.48 | 1.09 | 93 |
| Example 3 | Perpendicular | 4.3 | 10.4 | 58 | 0.25 | 2.28 | 2.90 | 2.17 | 2.35 | 2.31 | 1.08 | 94 |
| Example 4 | Perpendicular | 4.3 | 9.9 | 57 | 0.23 | 2.32 | 2.88 | 2.21 | 2.43 | 2.33 | 1.10 | 92 |
| Example 5 | Perpendicular | 4.4 | 10.7 | 57 | 0.23 | 2.22 | 2.78 | 2.12 | 2.30 | 2.23 | 1.08 | 94 |
| Example 6 | Perpendicular | 4.4 | 13.0 | 54 | 0.23 | 2.00 | 2.59 | 1.97 | 2.00 | 2.04 | 1.02 | 97 |
| Example 7 | Perpendicular | 4.4 | 9.2 | 67 | 0.23 | 1.56 | 1.94 | 1.49 | 1.63 | 1.55 | 1.09 | 94 |
| Example 8 | Perpendicular | 4.4 | 10.2 | 60 | 0.26 | 2.38 | 3.09 | 2.15 | 2.50 | 2.50 | 1.09 | 92 |
| Example 9 | Perpendicular | 4.3 | 10.3 | 62 | 0.27 | 2.49 | 3.22 | 2.30 | 2.64 | 2.52 | 1.09 | 93 |
| Example 10 | Perpendicular | 4.4 | 10.2 | 61 | 0.27 | 2.47 | 3.10 | 2.24 | 2.60 | 2.57 | 1.09 | 93 |
| Example 11 | Perpendicular | 4.2 | 10.1 | 59 | 0.26 | 2.75 | 3.57 | 2.49 | 2.83 | 2.94 | 1.09 | 92 |
| Example 12 | Perpendicular | 4.4 | 10.2 | 59 | 0.28 | 2.68 | 3.42 | 2.39 | 2.77 | 2.88 | 1.09 | 91 |
| Comp. Ex. 1 | Rotational direction | 2.9 | 5.8 | 126 | 0.29 | 4.32 | 5.52 | 4.02 | 4.57 | 4.38 | 1.14 | 85 |
| Comp. Ex. 2 | Perpendicular | 5.8 | 16.9 | 35 | 0.31 | 4.89 | 6.23 | *1 | 4.66 | 5.12 | unmeasur-able | 86 |
| Comp. Ex. 3 | Perpendicular | 3.2 | 6.7 | 70 | 0.19 | 4.10 | 5.26 | 3.70 | 4.39 | 4.21 | 1.19 | 82 |
| Comp. Ex. 4 | Rotational direction | 2.1 | 3.3 | 172 | 0.24 | 4.86 | 6.13 | 4.41 | 4.98 | 5.20 | 1.13 | 78 |
| Comp. Ex. 5 | Rotational direction | 2.8 | 5.3 | 132 | 0.33 | 4.78 | 6.03 | 4.38 | 5.07 | 4.88 | 1.16 | 80 |

*1: Unmeasurable due to generation of chill crystals instead of columnar crystal grains.

TABLE 3

| | Alloy strip surface | | | | Sintered magnet Mean | Magnetic properties | |
|---|---|---|---|---|---|---|---|
| | Crystal width P (mean value) μm | Number of crystal nuclei generated (no/mm$^2$) | Crystal group aspect ratio (mean value) | Area occupancy (%) | particle size (μm) | Br (kG) | Hcj (kOe) |
| Example 1 | 44 | 843 | 0.94 | 93 | 3.32 | 13.9 | 16.5 |
| Example 2 | 45 | 865 | 0.93 | 93 | 3.25 | 14.0 | 16.7 |
| Example 3 | 40 | 902 | 0.95 | 95 | 3.43 | 14.1 | 16.4 |
| Example 4 | 41 | 920 | 0.93 | 94 | 3.22 | 14.0 | 16.3 |
| Example 5 | 42 | 908 | 0.93 | 94 | 3.86 | 13.2 | 18.2 |
| Example 6 | 42 | 903 | 0.90 | 90 | 2.98 | 13.8 | 18.8 |
| Example 7 | 45 | 1023 | 0.90 | 95 | 3.27 | 12.6 | 20.6 |
| Example 8 | 42 | 879 | 0.93 | 93 | 3.76 | 13.4 | 18.1 |
| Example 9 | 47 | 840 | 0.92 | 92 | 3.32 | 15.0 | 15.6 |
| Example 10 | 44 | 833 | 0.93 | 91 | 3.36 | 13.9 | 15.8 |
| Example 11 | 52 | 782 | 0.94 | 88 | 3.80 | 13.9 | 15.2 |
| Example 12 | 50 | 788 | 0.94 | 90 | 3.83 | 14.0 | 14.5 |
| Comp. Ex. 1 | 110 | 685 | 0.68 | 80 | 3.26 | 13.8 | 13.8 |
| Comp. Ex. 2 | 20 | 435 | 0.93 | 31 | 3.51 | 13.6 | 12.5 |
| Comp. Ex. 3 | 62 | 768 | 0.94 | 93 | 3.47 | 13.8 | 14.0 |
| Comp. Ex. 4 | 131 | 572 | 0.63 | 72 | 3.68 | 13.5 | 19.1 |
| Comp. Ex. 5 | 124 | 585 | 0.65 | 76 | 3.65 | 13.8 | 12.5 |

Based on the results shown in Table 3, it was confirmed that the R-T-B sintered magnets of each of the examples have excellent coercive force without containing essentially any heavy rare earth elements such as Dy, Tb and Ho, and have coercive force equivalent to Comparative Example 4 which contains Dy.

[Structural Analysis of R-T-B Sintered Magnets]

(Area and Standard Deviation for Triple Point Regions)

Figure 19:
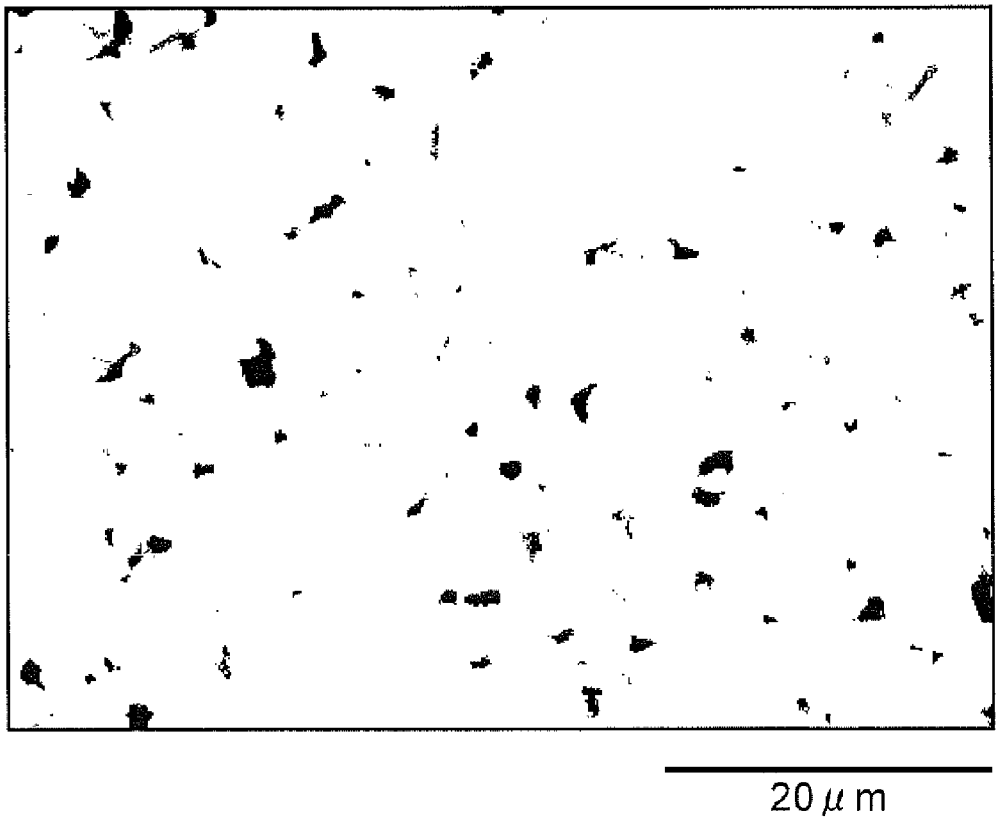
FIG. 19 is a diagram showing element map data for the R-T-B sintered magnet of Example 1, with the triple point regions indicated in black.

For the R-T-B sintered magnet of Example 1 there was used an electron beam microanalyzer (EPMA: JXA8500F Model FE-EPMA), and element map data were collected. The measuring conditions were: an acceleration voltage of 15 kV, an irradiation current of 0.1 μA and a count-time of 30 msec, the data acquisition region was X=Y=51.2 μm, and the number of data points was X=Y=256 (0.2 μm-step). In the element map data, first triple point regions surrounded by 3 or more crystal grains are colored black, and image analysis was performed to calculate the average value for the area of the triple point regions and the standard deviation for the area distribution. FIG. 19 is a diagram showing element map data for the rare earth sintered magnet of Example 1, with the triple point regions indicated in black.

Figure 20:
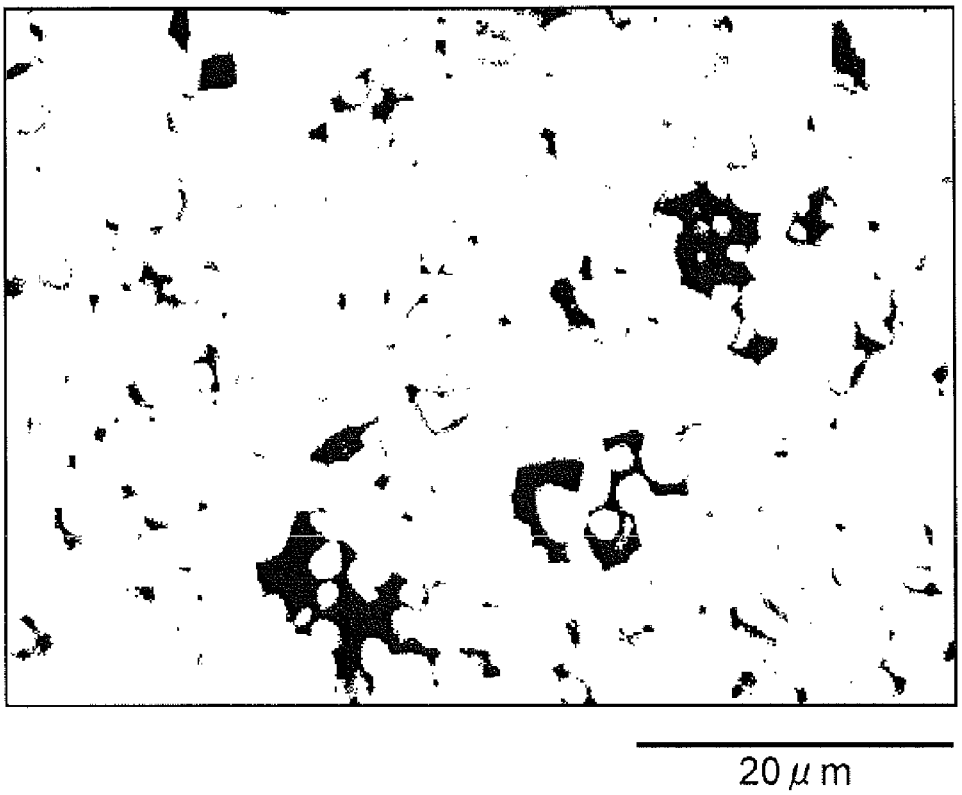
FIG. 20 is a diagram showing element map data for the R-T-B sintered magnet of Comparative Example 5, with the triple point regions indicated in black.

The EPMA was used for structural observation of the R-T-B sintered magnets of Examples 2 to 12 and Comparative Examples 4 and 5 in the same manner as the R-T-B sintered magnet of Example 1. FIG. 20 is a diagram showing element map data for the R-T-B sintered magnet of Comparative Example 5, with the triple point regions indicated in black.

The average value for the triple point region areas and the standard deviation for the area distribution were calculated for the R-T-B sintered magnets of each of the examples and comparative examples. The results are shown in Table 4. As shown in Table 4, the R-T-B sintered magnets of each of the examples had sufficiently smaller values for the average value and standard deviation for the area of the triple point regions, compared to Comparative Example 5. These results confirmed that in the examples, segregation of the phase with a higher R content than the $R_2T_{14}B$ phase was sufficiently inhibited.

(Rare Earth Element Content of Triple Point Regions)

An EPMA was used to determine the mass contents of rare earth elements in the triple point regions of the R-T-B sintered magnets of the examples and comparative examples. The measurement was conducted for 10 triple point regions, and the range and standard deviation for the rare earth element content was determined. The results are shown in Table 4.

(Oxygen, Nitrogen and Carbon Contents)

A common gas analysis apparatus was used for gas analysis of the R-T-B sintered magnets of the examples and comparative examples, and the oxygen, nitrogen and carbon contents were determined. The results are shown in Table 4.

(Corrosion Resistance)

The R-T-B sintered magnets of each of the examples and comparative examples were worked into rectangular solid shapes [size: 15×10×2 (mm)] to prepare samples for corrosion resistance evaluation. Each sample was subjected to a holding test with holding for 100 hours and 400 hours in an environment with a temperature of 120° C., a relative humidity of 100% and a pressure of 2 atmospheres. The surface condition of the test sample was visually examined and evaluated on the following evaluation scale. The evaluation results are shown in Table 4.

A: No particular abnormalities in outer appearance.

B: Small amount of powder falling produced.

C: Large amount of powder falling produced.

TABLE 4

| | Triple point region area | | Rare earth elements of triple point regions | | Oxygen content | Nitrogen content | Carbon content | Corrosion resistance | |
|---|---|---|---|---|---|---|---|---|---|
| | Mean value ($\mu m^2$) | S.D. | Content (mass %) | S.D. | (ppm) | (ppm) | (ppm) | 100 hrs | 400 hrs |
| Example 1 | 1.2 | 1.1 | 92-98 | 2.4 | 590 | 560 | 1100 | A | A |
| Example 2 | 1.8 | 2.6 | 91-98 | 2.7 | 890 | 820 | 950 | A | A |
| Example 3 | 1.5 | 2.3 | 92-98 | 2.5 | 780 | 780 | 1020 | A | A |
| Example 4 | 1.7 | 2.1 | 91-98 | 2.8 | 650 | 870 | 980 | A | A |
| Example 5 | 1.9 | 1.7 | 93-98 | 2.6 | 1420 | 1010 | 1380 | A | A |
| Example 6 | 1.7 | 2.2 | 91-98 | 2.6 | 570 | 530 | 1080 | A | A |
| Example 7 | 1.9 | 1.9 | 93-98 | 2.9 | 1200 | 890 | 1400 | A | A |
| Example 8 | 1.9 | 1.7 | 92-98 | 2.6 | 1410 | 1020 | 1390 | A | A |
| Example 9 | 1.7 | 2.0 | 90-98 | 2.8 | 680 | 860 | 980 | A | A |
| Example 10 | 1.6 | 2.1 | 91-98 | 2.7 | 690 | 870 | 1000 | A | A |
| Example 11 | 1.2 | 1.3 | 92-98 | 2.5 | 580 | 590 | 1060 | A | A |
| Example 12 | 1.1 | 1.5 | 91-98 | 2.4 | 570 | 550 | 1080 | A | A |
| Comp. Ex. 4 | 1.8 | 2.6 | 91-98 | 2.8 | 660 | 640 | 1200 | C | C |
| Comp. Ex. 5 | 3.4 | 7.1 | 82-98 | 5.7 | 800 | 760 | 1380 | A | B |

As shown in Tables 3 and 4, although each of the examples and Comparative Examples 1 to 3 and 5 used alloy powders having about the same mean particle diameter, the R-T-B sintered magnets obtained in the examples had higher HcJ values. This is presumably because the R-T-B sintered magnets of the examples not only had finer crystal grain particle diameters, but also had more uniform particle diameters and shapes of the crystal grains, and therefore reduced segregation of the triple point regions.

Based on the results in Table 4, it was confirmed that the R-T-B sintered magnets of the examples can exhibit high levels in terms of both high magnetic properties and excellent corrosion resistance.

INDUSTRIAL APPLICABILITY

According to the invention it is possible to provide an R-T-B sintered magnet having sufficiently excellent coercive force without using expensive and scarce heavy rare earth elements, as well as a method for its production.

According to the invention it is possible to provide an R-T-B sintered magnet with high magnetic properties and excellent corrosion resistance, as well as a method for its production. According to the invention it is also possible to provide a rotary machine capable of maintaining high output for prolonged periods.

EXPLANATION OF SYMBOLS

1: Crystal nucleus, 2: crystal grain ($R_2T_{14}B$ phase), 4: grain boundary region (phase with a higher R content than the $R_2T_{14}B$ phase), 10, 100: R-T-B sintered magnets, 12, 120: crystal grains, 14, 140: triple point regions (grain boundary regions), 11: high-frequency melting furnace, 13: molten alloy, 15: tundish, 16: cooling roll, 17: roll surface, 18: alloy strip, 19: gas tubing, 19*a*: gas blow hole, 20: table, 32, 34: recesses, 36: raised section, 40: rotor, 42: core, 50: stator, 52: coil, 60: dendritic crystal, 200: motor.

The invention claimed is:

1. An R-T-B sintered magnet comprising a composition containing a rare earth element, a transition element and boron, the R-T-B sintered magnet including essentially no dysprosium as a rare earth element, the R-T-B sintered magnet having crystal grains with a composition containing a rare earth element, a transition element and boron, and grain boundary regions formed between the crystal grains, wherein the crystal grains include an $R_2T_{14}B$ phase, and wherein triple point regions which are the grain boundary regions surrounded by 3 or more of the crystal grains include a phase with a higher R content ratio than the $R_2T_{14}B$ phase based on mass, and the triple point regions having a higher mass ratio of the rare earth element than the crystal grains, the average value of the area of the triple point regions in a cross-section being no greater than 2 $\mu m^2$ and the standard deviation for the area distribution being no greater than 3, and the content of rare earth elements in the triple point region being 80 to 99 mass %, and the standard deviation of the content distribution being no greater than 5, wherein R represents a rare earth element other than dysprosium, T represents a transition element and B represents boron.

2. The R-T-B sintered magnet according to claim 1, comprising essentially no terbium and/or holmium as the rare earth element.

3. The R-T-B sintered magnet according to claim 1, wherein the mean particle diameter of the crystal grains is 0.5 to 5 μm.

4. The R-T-B sintered magnet according to claim 1, wherein the rare earth element content is 25 to 37 mass %, the boron content is 0.5 to 1.5 mass % and a cobalt content among the transition elements is no greater than 3 mass % but not including 0.

5. The R-T-B sintered magnet according to claim 1, comprising dendritic crystal grains containing an $R_2T_{14}B$ phase and grain boundary regions containing a phase with a higher mass ratio of rare earth elements than the $R_2T_{14}B$ phase, and wherein the R-T-B sintered magnet is obtained from, as starting material a ground product of an R-T-B alloy strip having an average value of no greater than 3 μm for the spacing between the phase with a higher R content than the $R_2T_{14}B$ phase in a cross-section.

6. A rotary machine comprising an R-T-B sintered magnet according to claim 1.

7. A method for production of the R-T-B sintered magnet including essentially no dysprosium, the method for production of an R-T-B sintered magnet comprising the steps of:

preparing an R-T-B alloy strip having dendritic crystal grains that have a composition containing a rare earth element, a transition element and boron, and grain boundary regions with a composition having a higher mass ratio of rare earth elements than the crystal grains, wherein the average value of the spacing between grain boundary regions is no greater than 3 μm;

grinding the R-T-B alloy strip to obtain an alloy powder; and molding and firing the alloy powder in a magnetic field to produce an R-T-B sintered magnet having a composition containing a rare earth element, a transition element and boron, wherein the R-T-B sintered magnet has crystal grains with a composition containing a rare earth element, a transition element and boron, and grain boundary regions formed between the crystal grains, wherein the crystal grains include an $R_2T_{14}B$ phase, and wherein triple point regions which are the grain boundary regions surrounded by 3 or more of the crystal grains include a phase with a higher R content ratio than the $R_2T_{14}B$ phase bused on mass, and the triple point regions a higher mass ratio of the rare earth element than the crystal grains, the average value of the area of the triple point regions in a cross-section being no greater than 2 $\mu m^2$ and the standard deviation for the area distribution being no greater than 3, and the content of rare earth elements in the triple point region being 80 to 99 mass %, and the standard deviation of the content distribution being no greater than 5, wherein R represents a rare earth element other than dysprosium, T represents a transition element and B represents boron.

* * * * *